United States Patent [19]

Kapp

[11] 4,326,815

[45] Apr. 27, 1982

[54] PAPER FEEDING APPARATUS AND METHOD FOR PRINTING APPARATUS

[75] Inventor: Ludwig J. Kapp, Montville, N.J.

[73] Assignee: Ziyad Incorporated, Denville, N.J.

[21] Appl. No.: 114,115

[22] Filed: Jan. 21, 1980

[51] Int. Cl.[3] ..... B41J 11/58

[52] U.S. Cl. ..... 400/625; 271/4; 400/629

[58] Field of Search ..... 271/3, 4, 9; 400/320, 400/322, 624–629, 632, 632.1, 708, 711, 712

[56] References Cited

U.S. PATENT DOCUMENTS

| | | | |
|---|---|---|---|
| 3,430,748 | 3/1969 | Parri | 400/629 X |
| 4,067,566 | 1/1978 | Williams | 400/625 X |
| 4,084,805 | 4/1978 | Simpson | 400/625 X |
| 4,089,402 | 5/1978 | Hyland et al. | 400/625 |
| 4,106,763 | 8/1978 | Tani | 271/9 |
| 4,113,244 | 9/1978 | Ruenzi | 271/4 |
| 4,143,981 | 3/1979 | Hansen et al. | 400/628 X |
| 4,189,135 | 2/1980 | Costa | 400/625 X |
| 4,212,456 | 7/1980 | Ruenzi | 400/629 X |
| 4,212,552 | 7/1980 | Bemis et al. | 400/144.2 X |
| 4,221,374 | 9/1980 | Koch et al. | 400/625 X |
| 4,222,557 | 9/1980 | Wu | 400/625 X |

OTHER PUBLICATIONS

IBM *Tech. Disc. Bulletin,* vol. 21, No. 12, May 1979, pp. 4751–4752, 271–279.

*Primary Examiner*—Paul T. Sewell

*Attorney, Agent, or Firm*—Lerner, David, Littenberg & Samuel

[57] ABSTRACT

A paper feeding apparatus for feeding of individual sheets of paper to a printing device for the printing of matter thereon, the printing device including a print head for printing on a sheet of paper and a paper moving platen for providing relative movement between sheets of paper and the print head to effect printing on the paper. The paper feeding apparatus includes a paper storage tray for storing a plurality of sheets of paper, and a paper drive and guide apparatus for feeding a sheet of paper from the paper storage tray along a paper feed path to the platen of the printing device. A sensor is provided in the paper feed path for sensing when a sheet of paper is in position for being received by the platen, at which time the platen is then actuated to receive the sheet of paper being fed along the paper feed path and to move the sheet of paper relative to the print head to accurately position the sheet of paper in a printing position for the start of printing thereon by the print head. In the preferred embodiment, a second sensor is provided along a paper exit path from the printing device which is utilized to indicate that the platen has received a sheet of paper and to position the paper properly in a printing position for the start of printing. Further, apparatus are provided for ejecting the paper from the printing device after printing has been completed on the sheet of paper.

71 Claims, 17 Drawing Figures

PAPER FEEDING APPARATUS AND METHOD FOR PRINTING APPARATUS

BACKGROUND OF THE INVENTION

The present invention relates to printing apparatus and paper feeding apparatus therefor, and more particularly to a paper feeding apparatus which will automatically feed individual sheets of paper to a printing device, and properly align and position the paper for the start of printing thereon by the printing device.

Tremendous advances have been made in the last few years in automating office procedures. Conventional typewriters have grown into mini-computers performing word processing, storage and other functions. The speed at which these machines produce words on paper is increasing at a rapid rate.

As added speed and sophistication are developed into such machinery, the actual putting of words onto paper becomes auxilliary to the main function of collecting and organizing the information into a format to be printed. In order to have flexibility and speed, many systems have been developed where an operator manipulates words on a cathode ray tube or other word processing equipment until the final copy is in the format desired. With all of these advances, it has developed that today one of the major bottlenecks in terms of time, and therefore usefulness of this equipment, is the rate at which paper can be brought to and moved past a printing head to produce the final hard copy.

Of course it is possible to use continuous sheets of perforated paper, as is commonly done in computer applications, having sprocket holes along the side thereof to continuously feed and move the paper through an impact printer. This however requires special paper which is not suited to the many requirements for which normal typewriting is employed.

Many machines exist, both copying machines and printing machines, which automatically feed paper past a printing or reproducing station. These machines are normally run synchronously such that prior to the time that paper is fed, the information to be imparted to the paper is already organized and the paper is moved past the printing head in a continuous fashion. This is not suitable for impact printing devices since impact printing is accomplished with the paper stationary rather than moving, and further the adaptation of normal typewriting type printing requires the moving of paper not only on an intermittant basis but also in the forward and reverse direction in accordance with the information to be typed. Still further, with such existing equipment, it is generally not possible to manually feed separate sheets of paper, which may be of a different size or thickness (such as for example envelopes), without disconnecting the equipment from the printing apparatus.

It is of course possible to radically change the printing equipment to conform with the needs of high-speed paper feeding. However, it is an object of this invention to provide a paper feeding apparatus to conform with the requirements of existing impact printing equipment rather than requiring the radical modification thereof. In particular, it is an object to provide a paper feeding apparatus which is capable of being retrofitted with respect to existing printing devices (i.e., distributed as an after market product) as well as being capable of being sold and distributed with or as an integral part of the printing apparatus.

SUMMARY OF THE INVENTION

In accordance with the present invention, there is provided a paper feeding apparatus for feeding of sheets of paper to a printing device which will serve to effect printing on the sheet of paper, the printing device including printing means for printing on a sheet of paper and paper drive means for providing relative movement between a sheet of paper and the printing means to effect printing on the sheet of paper. According to one aspect of the present invention, the paper feeding apparatus comprises paper storing means for storing a plurality of individual sheets of paper and paper feed means for feeding a sheet of paper from the paper storing means in a paper feed direction along the paper feed path to the paper drive means of the printing device. The paper feed means is operable to release the sheet of paper when it is received by and initially moved by the paper drive means in the paper feed direction, and the paper feed means is so positioned that the paper feed means is out of the path of movement of a released sheet of paper when thereafter moved by the paper drive means. In this manner, a sheet of paper may be moved by the paper drive means in either the forward or reverse directions without interference from the paper feed means. This will enable the printing of columns, superscripts and subscripts, or other special printing operations by the printing device which have not heretofore been possible in automatically fed printing equipment.

According to another aspect of the present invention, the paper feeding apparatus includes first and second spaced guide plate members which together define a first feed path and a second feed path for movement of sheets of paper. The first feed path has a first end spaced from the paper drive means of the printing device and a second end arranged adjacent the paper drive means for guiding a sheet of paper for movement towards and away from the paper drive means along the first feed path. The second feed path has the first end spaced from the first feed path and adjacent a paper storing means for the storing of individual sheets of paper, and a second end arranged adjacent the first feed path intermediate the first and second ends of the first feed path for guiding a sheet of paper into the first feed path. The paper feeding apparatus also includes paper feed means for feeding a sheet of paper from the paper storing means along the second feed path into the first feed path to the paper drive means. The first and second paths are oriented relative to one another such that a sheet of paper which is fed along the second feed path towards the second end of the second feed path is directed into the first feed path and directed towards the paper drive means, and such that a sheet of paper in the first feed path is movable therealong in a direction toward the first end of the first feed path past the second end of the second feed path without entering the second feed path. The first and second guide plate members thus provide an arrangement by which the paper drive means of the printing device may move the sheet of paper in any desired manner for the printing of columns, superscripts and subscripts or other special printing functions without interference from paper stored in the paper storing means.

According to a still further aspect of the present invention, the paper feeding apparatus includes paper storing means for storing a plurality of individual sheets of paper, plate means which includes a first surface for defining a paper feed path to the paper drive means, and a second surface, and paper feed means for feeding a sheet from the paper storing means along the paper feed path to the paper drive means. A receptacle is also provided for receiving a sheet of paper from the printing device, the receptacle being at least partially defined by the second surface of the plate means, and ejection means are provided for ejecting and guiding the sheet of paper from the printing device into the receptacle when printing on the sheet of paper by the printing means has been completed. In the preferred embodiment, the plate means comprises a single plate member which has the first surface defined on one side thereof and the second surface defined on the opposite side thereof. This arrangement provides for a compact paper feed apparatus which operates to guide sheets of paper from the paper storing means into the printing device for movement by the paper moving means thereof and which also includes a receptacle for receiving paper after the printing has been effected thereon.

In accordance with a still further aspect of the present invention, the paper feeding apparatus includes paper storing means for storing a plurality of individual sheets of paper and guide means defining a paper feed path extending between the paper storing means and the paper drive means. A pair of spaced apart drive rollers are provided which are positioned adjacent the paper storing means and spaced from the guide means for driving a sheet of paper in a paper feed direction from the paper storing means into the paper feed path. Further, the spaced apart drive rollers are positioned to engage a sheet of paper at positions which are on opposite sides of the longitudinal center line of the sheet of paper (i.e., extending in the direction of movement of the paper) regardless of the width of the paper. In this manner, it will be appreciated that different width sheets of paper may be driven by the same pair of drive rollers.

In a further aspect of the present invention, the paper moving means of the printing device includes a transversely extending platen, and the printing means includes a printing head transversely movable relative to the transversely extending platen and a guide member for guiding a sheet of paper in a desired direction, the guide member being associated with the transversely movable print head and movable therewith. Printing is effected by moving the printing head relative to the platen and by the platen longitudinally moving a sheet of paper relative to the print head. In this aspect, the paper feeding apparatus comprises paper storing means for storing a plurality of individual sheets of paper and paper feed means for feeding a sheet of paper in a paper feed direction from the paper storing means to the platen. The sheet of paper has a longitudinal central portion which extends in the paper feed direction and which is centrally located intermediate the edges of the sheet of paper which extend in the paper feed direction. Paper receiving means are provided which define a paper exit path having one end arranged adjacent the platen to receive a sheet of paper therefrom after the printing head has effected printing thereon. The paper feeding apparatus further includes centering means for transversely moving the print head and associated guide member to a position to overlie at least a part of the central portion of the sheet of paper when the sheet is moved therepast upon initial feeding of a sheet of paper to the platen so that the guide member cooperates with the platen to guide the sheet of paper into the paper exit path. It will be noted in this regard, that the guide member of the printing device comprises a conventional element of the printing device. Thus, in this aspect of the present invention, the guide member is utilized for the purpose of guiding a sheet of paper fed by the paper feeding apparatus along the proper path for receipt by the paper receiving means after printing has been effected thereon, without the need for providing for separate fixed or movable guide components.

In accordance with a further aspect of the present invention, a paper feeding apparatus and a method of feeding paper are provided. In this aspect of the present invention, a plurality of individual sheets of paper are stored in paper storing means, and a sheet of paper is fed from the paper storing means along a paper feed path to the paper drive means. Sensing means are provided for sensing when a sheet of paper is in position for being received by the paper drive means and, when in the proper position, the paper drive means is actuated to receive the sheet of paper and to move the sheet of paper relative to the printing means for accurately positioning the sheet of paper in a printing position for the start of printing thereon by the printing means. In accordance with the preferred embodiment of this aspect, second sensor means are provided for sensing whether the paper drive means has received a sheet of paper and for aligning the sheet of paper at a precise position in reference to a desired position for the start of printing thereon. This second sensor means is preferably positioned adjacent a paper exit path to sense when the leading edge of the paper passes the second sensor means, thereby indicating that the platen has received and moved the sheet of paper. Also, the second sensor means is located at predetermined distance from the print head to provide a reference for properly positioning of the paper relative to the print head after being sensed by the second sensor.

Still further in accordance with the present invention, there is provided a printing apparatus which comprises a printing device having printing means for printing on a sheet of paper and paper drive means for providing relative movement between a sheet of paper and the printing means to effect printing on the sheet of paper, and a paper feeding apparatus, in accordance with the various aspects and features thereof noted above, for feeding of a sheet of paper to the paper drive means.

These and further features and characteristics of the present invention will be apparent from the following detailed description in which reference is made to the enclosed drawings which illustrate a preferred embodiment of the present invention.

DETAILED DESCRIPTION OF THE PREFERRED EMBODIMENT

Figure 1:
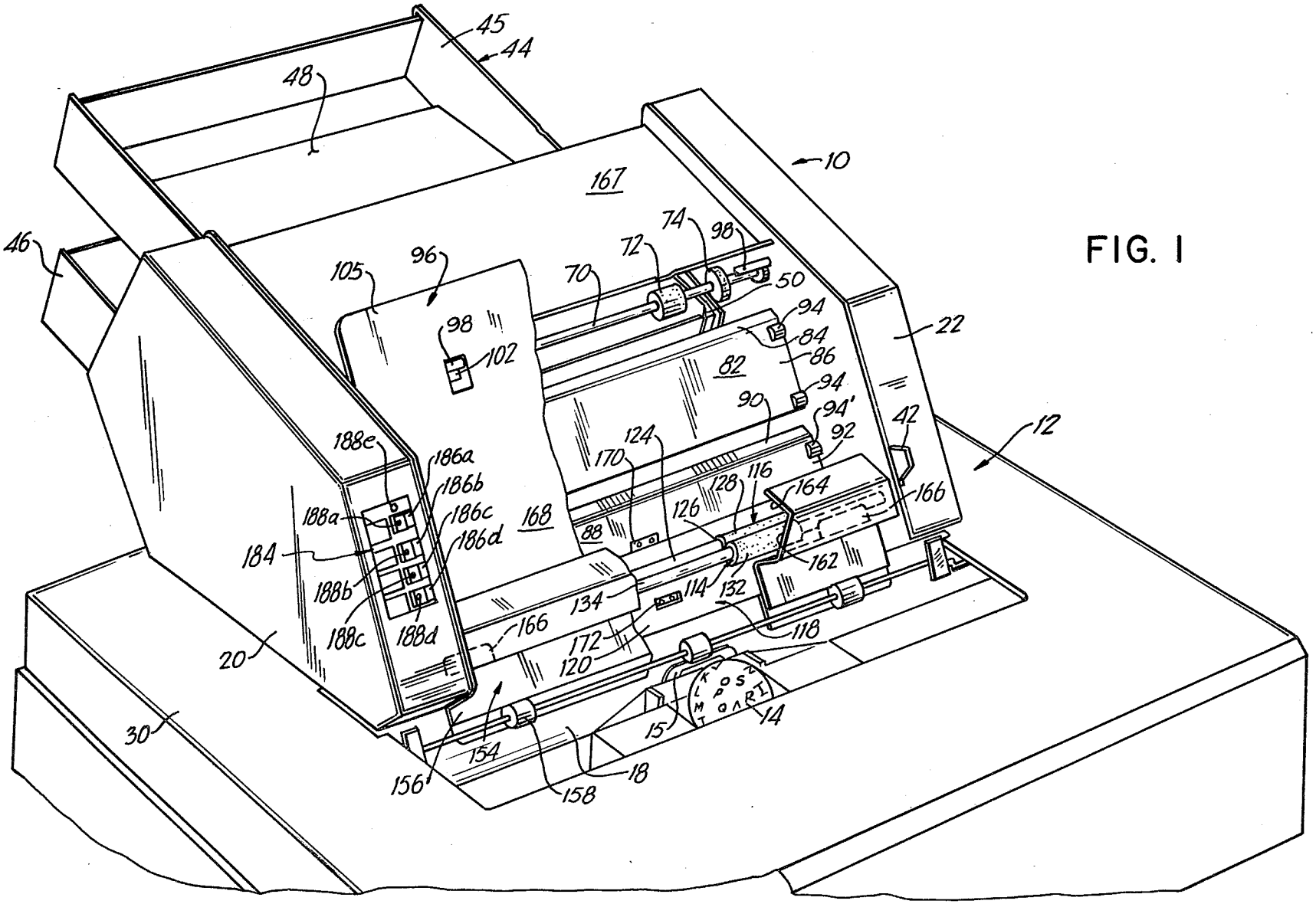
FIG. 1 is a perspective view of the paper feeding apparatus in accordance with the present invention mounted on a printing device, portions of the paper feeding apparatus being broken away to illustrate various components thereof.

Referring now to the drawings wherein like reference characters represent like elements, there is shown in FIG. 1 a paper feeding apparatus 10 in accordance with the present invention mounted onto a printing device 12 for operation in conjunction therewith. The printing device 12 generally includes printing means 14 for printing on a sheet of paper 16 and paper drive means 18 for providing relative movement between a sheet of paper 16 and the printing means 14 to effect printing on the sheet of paper 16. For example, in the embodiment shown in FIG. 1, the paper moving means comprises a rotatable transversely extending platen 18 which is adapted to rotate about a transversely extending axis, and the printing means comprises a movable print head 14 which is adapted to traverse back and forth across the transverse length of the platen 18. As is conventional, a sheet of paper 16 to be printed on is received between the platen 18 and the paper guide therefor, which may include appropriate pressure rollers 19 in engagement with the platen 18 (see FIG. 8 for example), and advanced by rotation of the platen 18. The print head or wheel 14 is carried by a movable carriage which traverses across the transverse extent of the platen 18 by means of a suitable carriage motor. The print head 14 is arranged to be closely spaced from the platen 18 so that printing in lines is achieved on the paper 16 as the print head 14 traverses between the ends of the platen 18. Alternatively, the platen 18 could be carried by a carriage and moved transversely past the print head or means. During the printing operation, the platen 18 serves to rotate intermittently about the transverse axis to advance the sheet of paper 16 longitudinally relative to the print head 14 for the printing of the next line thereon by virtue of the transverse movement of the print head 14 with respect thereto.

Thus, it is appreciated that in the embodiment shown in FIG. 1, printing is accomplished by transversely moving the print head or wheel 14 relative to the paper 16 and then advancing the paper 16 longitudinally by rotation of the platen 18 to permit the print wheel 14 to traverse thereacross to effect the next line of printing. This printing operation may be as in a conventional typewriter from left to right, or the printing may be from left to right for one line of print with the next line of print being effected by movement of the printing head from right to left. This latter means of printing is commonly used in many present day word processing systems.

The paper feeding apparatus 10 in accordance with the present invention is mainly designed for use with printing devices 12 having automatic printing or typing capabilities, i.e., printing systems or devices in which a complete page of print is effected automatically without or with a minimal amount of instructions from the user. In such systems, the text of the matter to be printed may have been previously stored on a disk or other similar recording device, or may be in the memory of a cathode ray tube on which a user has completed work to arrange the matter or information in a desired format. When desired, the system simply prints the stored information onto sheets of paper.

Generally, in the printing operation, the matter of information is printed one line at a time, with the paper 16 then being automatically advanced for effecting printing of the next line, and so on until an entire page is printed. Such printing devices 12 are generally of the impact printing type, i.e., the print head impacts the paper 16 against the platen 18 to effect the printing. However, it should be appreciated that the paper feeding apparatus 10 in accordance with the present invention could also be used with other types of printing devices, such as for example ink jet printers, line printers, and/or non-impact electro-static printers.

As will be appreciated from the description hereinbelow, the paper feeding apparatus 10 in accordance with the present invention is also particularly well adapted to be retrofitted with such automatic printing devices 12, both in terms of the mechanical mounting on the printing device 12 as well as the electrical connections with the microprocessor or other control equipment for controlling the printing device 12 to print matter on sheets of paper. This is a most important capability as, as was noted in the Background of the Invention section above, present day information and paper handling systems have developed to a stage where the limiting factor with respect to the speed of handling and printing is the speed at which paper can be delivered and positioned for printing thereon by the printing device 12. Consequently, it is desirable that the paper feeding apparatus 10 for accomplishing the paper feeding and removal of the paper from the printing device 12 be capable of being universally adapted, with a minimum amount of changes or modifications, for use with such present day printing devices. In this regard, as automatic printing devices 12 have control capabilities for controlling the printing of words in a line and automatically advancing the paper for printing of the next line, the paper feeding apparatus 10 of the present invention preferably is capable of connection to the printing device 12 so as to use the standard commands generated for movement of the printing head 14 and advancement of sheets of paper 16, thus simplifying the retrofitting of the paper feeding apparatus 10 with an automatic printing device 12. In this regard, information respecting the standard commands and codes for movement of the platen 18 and the print head 14, as available from the printer interface and as used herein, are set forth in the Interface Manual as published by the printer manufacturer. Accordingly, the paper feeding apparatus 10 of the present invention is capable of distribution as an after market product, as well as for distribution with the sale of new printing equipment, in which event the paper feeding apparatus 10 may either be sold as a separate unit or as an integral unit with the printing device 12.

One example of such a typical printing device or system having the capability to automatically print matter, and one with which the preferred embodiment of the paper feeding apparatus 10 of the present invention is especially designed for use, is the Lanier Business Products' word processing unit sold under the tradename "No Problem" which includes suitable control commands for effecting an automatic printing of an entire page of type or print on a sheet of paper 16 automatically and which includes paper advance instructions (as by an instruction to rotate the platen 18) and other suitable controls for controlling the margins for the matter to be printed with respect to the paper.

Accordingly, the paper feeding apparatus 10 in accordance with the present invention is operable to feed sheets of paper 16 to the printing device 12, and in particular to the platen 18 thereof, and to control the platen or paper drive means 18 of the printing device 12 to move the paper 16 fed thereto to an appropriate position for printing to begin on the sheet of paper 16. Also, after printing has been completed, the paper feeding apparatus 10 is preferably operable to remove or eject the paper 16 from the printing device 12, to store or stack same in the paper feeding apparatus 10, and to then feed another sheet of paper 16 and move same into position for the beginning of printing thereon.

With the above features and principles in mind, the paper feeding apparatus 10 in accordance with the present invention will now be described.

Figure 3:
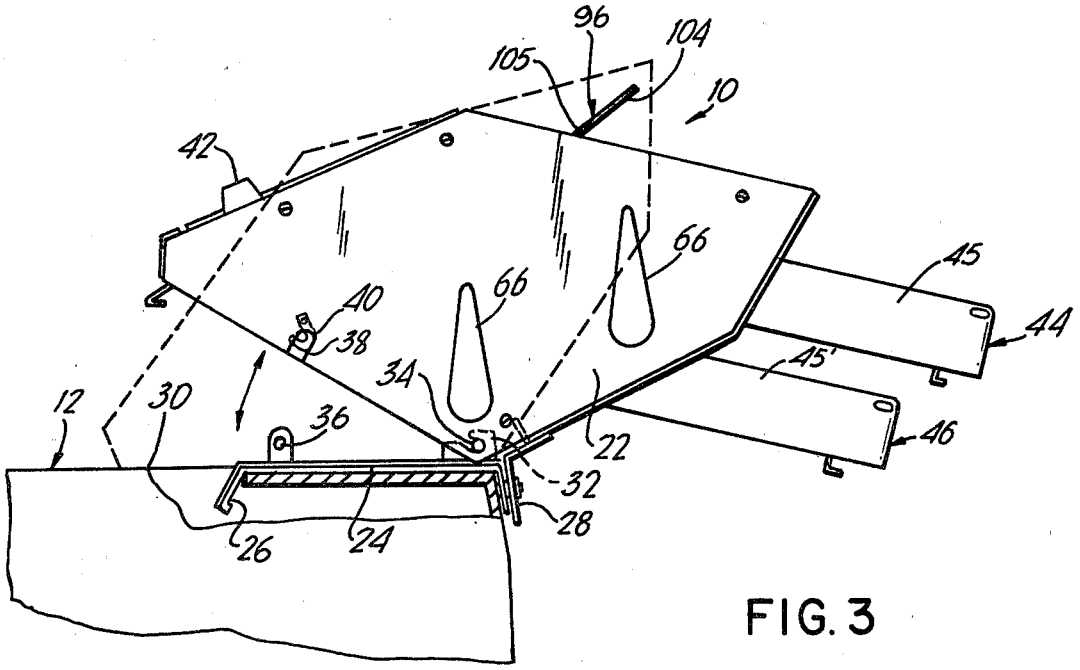
FIG. 3 is a side elevational view illustrating the paper feeding apparatus of the present invention mounted on a printing device, showing in full outline the paper feeding apparatus in a raised position for the manual feed of sheets into the printing device without utilizing the paper feeding apparatus and showing in dotted outline the paper feeding apparatus in a lowered position for the automatic feeding of sheets of paper to the printing device.
Figure 4:
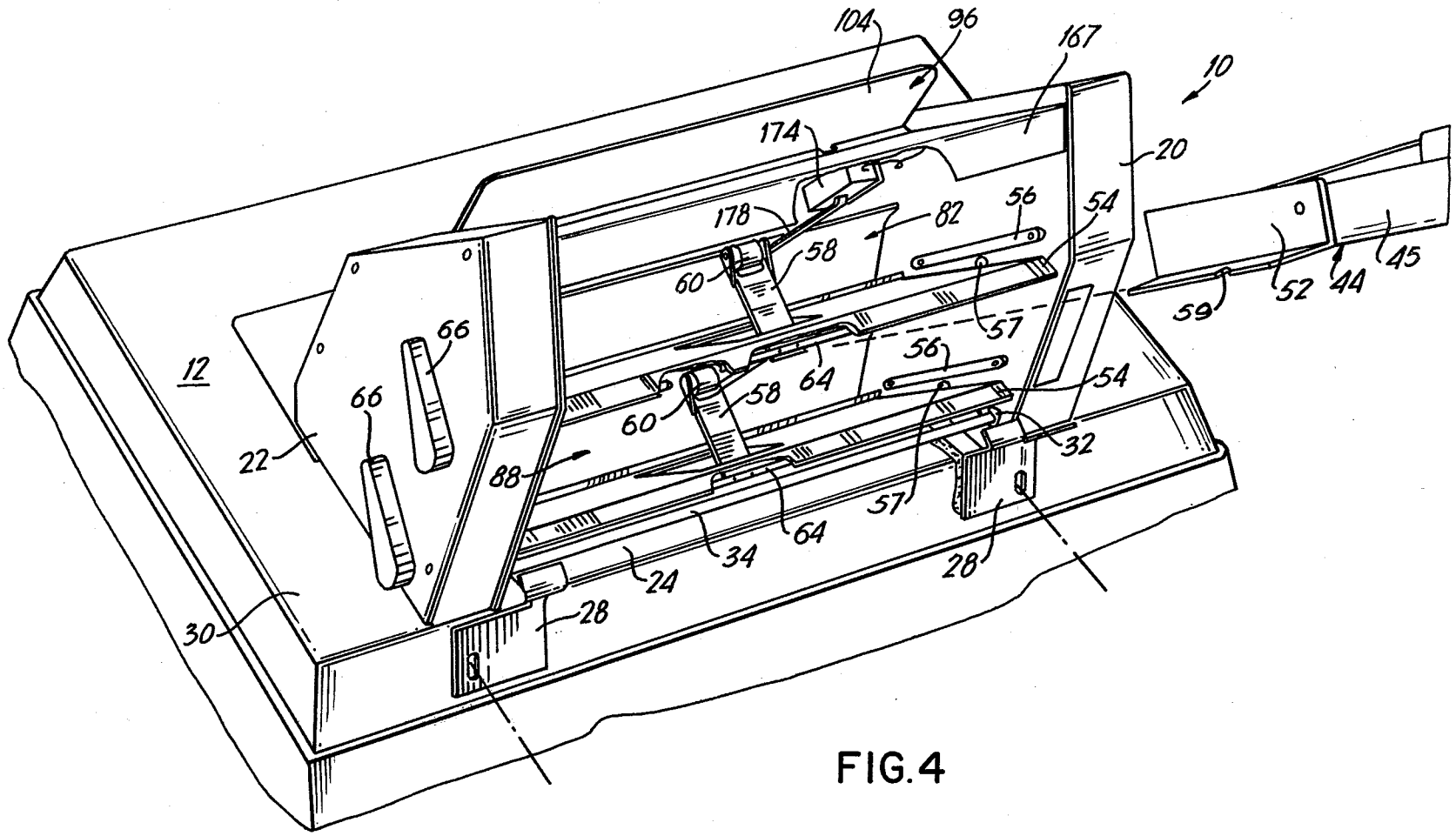
FIG. 4 is a rear perspective view of the paper feeding apparatus of the present invention and with the paper trays removed to illustrate various components of the apparatus.

The paper feeding apparatus 10 generally comprises a pair of upstanding generally parallel spaced side housings or covered frames 20, 22 between which sheets of paper 16 will be fed to the printing device 12. The side housings 20, 22 are joined together and supported on a base support member or mounting plate 24 for mounting of the paper feeding apparatus 10 onto the printer 12 so as to be in a proper position for feeding sheets of paper 16 to the platen 18 thereof. In the preferred embodiment, this mounting plate 24 comprises a generally flat plate member having mounting means or brackets 26, 28 at the front and rear transverse ends thereof, and provides a suitable support surface for supporting the paper feeding apparatus 10 on the printing device 12. The mounting plate 24 is designed to be attached to the rear top portion or cover 30 of the printer device 12 behind the paper moving platen 18 and the transversely movable printing head 14. The dimensions and configuration of the mounting plate 24 may be varied depending on the particular printing device with which the paper feeding apparatus 10 is to be used, so that the paper feed path of the paper feeding apparatus 10 will be properly aligned with the paper moving platen 18 of the printing device 12. As best shown in FIGS. 3 and 4, the mounting plate 24 is attached in a suitable fashion with the mounting means 26, 28 to the upper rear cover 30 of the printing device 12.

In the preferred embodiment, the mounting plate 24 includes a pair of transversely spaced rear hook members 32 (see FIGS. 3, 4 and 5) for receiving a transversely extending support or attaching bar 34 which extends between the upright side housings 20, 22 at the rear of the paper feeding apparatus 10. A forward transversely extending support bar 36 (see FIGS. 3 and 5) is provided at the forward end of the mounting plate 24 which is adapted to be received in appropriate recesses 38 in the upright housings 20, 22 of the paper feeding apparatus 10. The paper feeding apparatus 10 is easily attached to this mounting plate 24 by hooking the attaching bar 34 at the rear bottom of the paper feeding apparatus 10 in the hooks 32 provided at the rear of the mounting plate 24 and then lowering, by rotation about the rear attaching bar 34, the paper feeder apparatus 10 into position onto the printer 12 so that the forward support bar 36 is received in the recesses 38 in the interior of the side housings 20, 22. It will be appreciated that the paper feeder apparatus 10 is rotatable about the attaching bar 34 between a lowered position (shown in dotted outline in FIG. 3) and an upper position (shown in full outline in FIG. 3) for a purpose to be described more fully hereinbelow. When in the lowered position, the paper feeding apparatus 10 is held in place relative to the printing device 12 and mounting plate 24 by means of a suitable locking device, which in the preferred embodiment comprises a spring biased pivotal hook member 40. Actuation for effecting locking and unlocking of the spring biased hook member 40 is achieved by depressing the locking button 42 on the front of the paper feeding apparatus 10.

Figure 6:
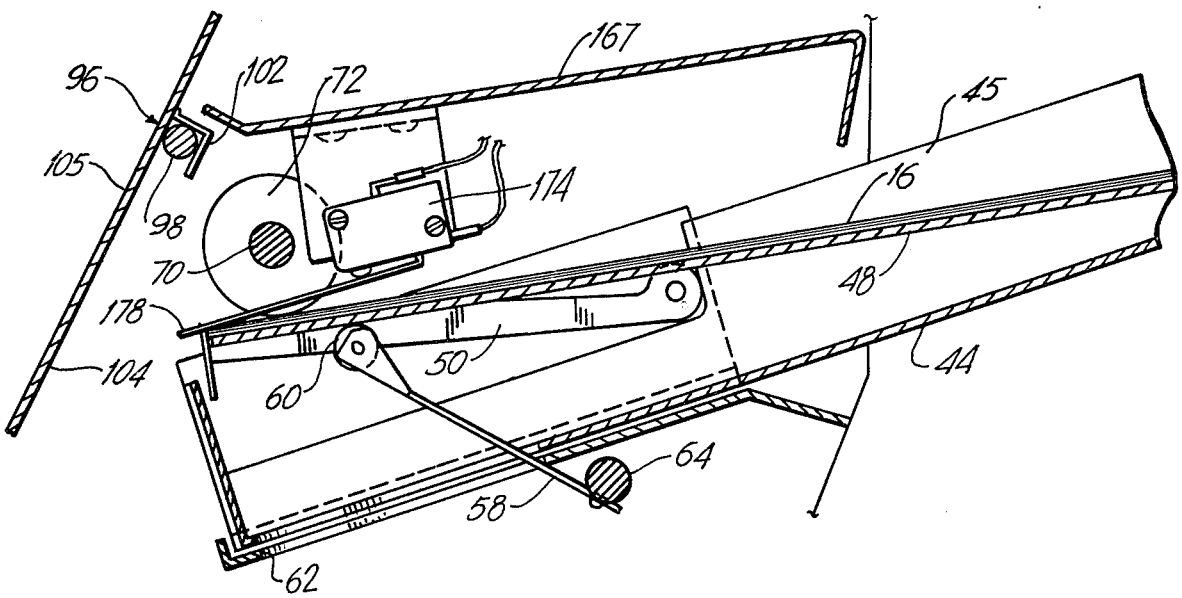
FIG. 6 is a sectional view taken along lines 6—6 of FIG. 2 illustrating how sheets of paper are supported in a paper tray and mounted in the paper feeding apparatus.

Also, in the preferred embodiment, a pair of paper trays 44, 46 are provided for storing a first and second plurality of sheets of paper 16 for feeding to the printing device 12. The paper trays 44, 46 are supported one above the other at the rearward end of the paper feeding apparatus 10. As each of the paper trays 44, 46 is similarly constructed and supported between the housings 20, 22, only the upper paper tray 44 and the manner of supporting same will be described. The upper paper tray 44 comprises a tray shaped box member 45 having a paper support plate 48 pivotally supported in the bottom thereof. The dimensions of the tray shaped box member 45 substantially correspond to the dimensions of the paper 16 to be supported therein. The sheets of paper 16 are placed on the paper support plate 48 and the paper support plate 48 is pivotable upwardly to raise the forward edges of the sheets of paper 16 to be at or just above the forward end of the paper tray 44 and in contact with drive rollers 72 for feeding of the paper (to be described more fully hereinbelow) (see FIG. 6). Also, suitable paper retention means may be provided for normally retaining the paper 16 in the paper tray 44, such as for example pivotable tab members 50 arranged at the forward side edges of the paper tray 44. These tab members 50 also serve to separate the sheets of paper 16 so that a single sheet of paper at a time will be fed by the drive rollers 72 from the paper tray 44.

Figure 7:
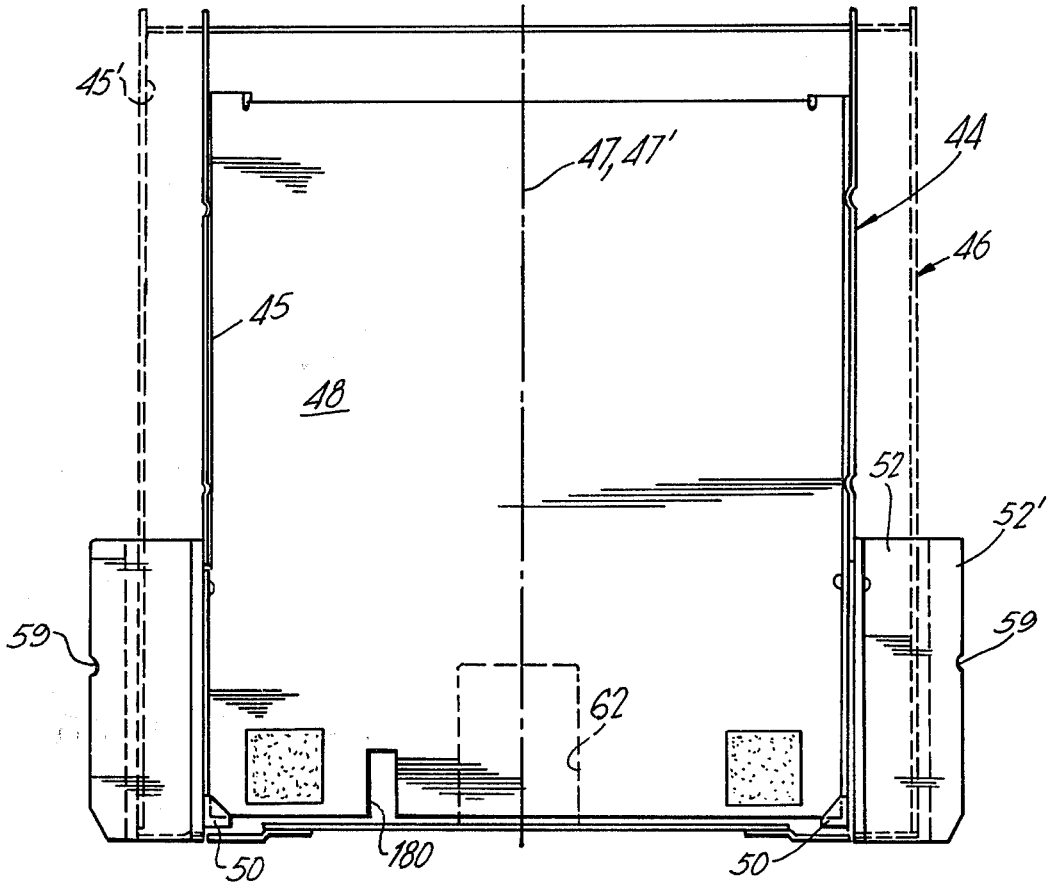
FIG. 7 is a plan view of the upper paper tray shown in full outline and of the lower paper tray shown in dotted outline superimposed therebeneath to illustrate different size paper trays for different sizes of paper.

The paper tray 44 is also provided with a pair of L-shaped brackets 52 each having one leg secured to the sides of the box shaped member 45 and the other leg extending away therefrom. The spacing between the outer ends of the L-shaped brackets 52 substantially corresponds to the spacing between the side housings 20, 22 so that the paper 16 in the paper tray 44 may be centered between the housing sides 20, 22. As can be appreciated, a paper tray for different width sheets of paper may similarly be centered between the side housings 20, 22 so that the paper thereof is also centered by simply constructing the paper tray therefor to have suitable dimensioned L-shaped brackets 52 secured to the sides thereof so that the outer ends of the L-shaped brackets 52 are spaced substantially the same distance as the spacing between the upright side housings 20, 22. This is illustrated in FIG. 7 which shows an upper paper tray 44 for one width of paper 16 in full outline, and a second or lower paper tray 46 superimposed thereunder in dotted outline for a second width of paper. Although the dimensions of the box shaped portions 45, 45' differ from one another, the outer dimensions for the L-shaped brackets 52, 52' are identical, and the center lines 47, 47' for each of the trays 44, 46 coincide with one another.

A tray support plate 54 is provided between the side housings 20, 22 for supporting the paper tray 44 (see FIG. 4). Each of the side housings 20, 22 is also provided with a bar 56 parallel spaced above the tray support plate 54 to define a space for receipt of the transversely or laterally extending legs of the L-shaped brackets 52 between the bar 56 and its respective tray support plate 54. A suitable spring biased detent ball 57 may be provided in this space in the side housings 20, 22 for receipt in a suitable recess 59 (see FIG. 7) in the laterally extending legs of the L-shaped brackets 52 to retain the paper tray 44 in position when it is inserted between the side housings 20, 22.

The tray support plate 54 is provided with a centrally located spring biased pivotable plate member 58 having a roller element 60 secured thereto for being received in an appropriate opening or recess 62 in the bottom of the paper tray 44 for resiliently pivoting the paper support plate 48 in the paper tray 44 upwardly to raise the forward edges of sheets of paper 16 supported thereon. More particularly, the plate member 58 is connected to a rotatable rod 64 journalled in the side housings 20, 22 and connected to one end to a paper tray insertion lever 66 located and mounted on the side housing 22. The tray insertion lever 66 is spring biased to bias the roller element 60 and plate member 58 towards the raised position, and is operable to pivot the roller element 60 and plate member 58 downwardly to permit insertion and removal of the paper tray 44. In the downward or lower position, the roller element 60 and plate member 58 lie beneath the surface of the tray support plate 54.

Spaced above the upper tray support plate 54, there is provided a transversely extending drive rod 70 having a first and second pair of spaced rollers 72, 74 secured thereto. The inner pair of rollers 72 are drive rollers which are spaced at equal distances from the transverse center of the drive rod 70 to engage spaced portions of the upper sheet of paper 16 urged into contact therewith by means of the spring biased roller element 60 which forces the paper support plate 48 upwardly. These inner drive rollers 72 each include a roller clutch mechanism so that the drive rollers 72 will be free rolling relative to the drive rod 70 in one direction (i.e., the counterclockwise direction relative to the drive rod 70 as viewed in FIG. 8) and will be locked with the drive rod 70 in the opposite direction (i.e., the clockwise direction relative to the drive rod 70 as viewed in FIG. 8). In this way, when the drive rod 70 is rotated (in a manner to be described hereinbelow) in the counterclockwise direction as viewed in FIG. 8, the drive rollers 72 will be rotated therewith to engage and force a single sheet of paper 16 from the supply tray 44 forwardly thereof. On the other hand, when the drive rod 70 stops rotation and the paper is pulled out of the paper tray (as described below), the drive rollers 72 will be free to rotate in the counterclockwise direction.

The outer pair of rollers 74 comprise freely rotating idler or support rollers 74 which are adapted to assist in feeding a sheet of paper from a paper tray (when inserted between the side housings 20, 22) which is of a greater lateral dimension than the paper 16 in the tray 44 (see FIG. 7). The support rollers 74 are not driven by the drive rod, but rather simply provide an additional means for reliable separation and feeding of relatively wide sheets of paper from a paper supply tray 44.

Figure 2:
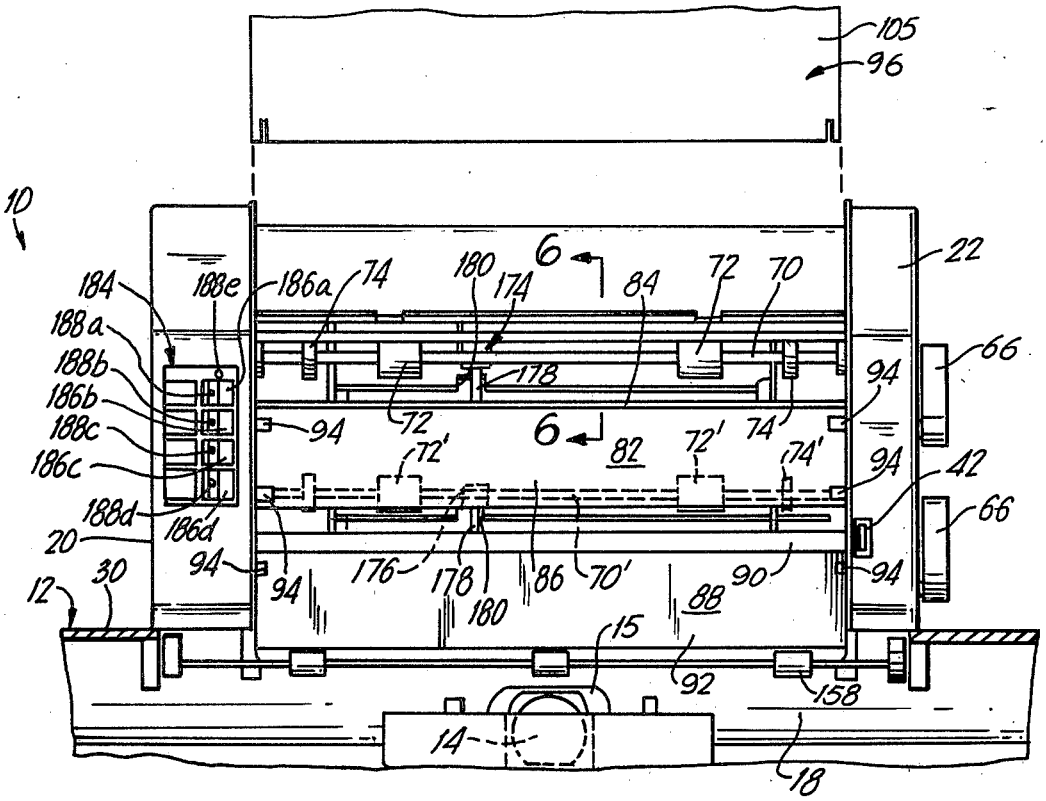
FIG. 2 is a front elevational view of the paper feeding apparatus of FIG. 1 mounted on the printing device, with portions removed to illustrate various components thereof.
Figure 5:
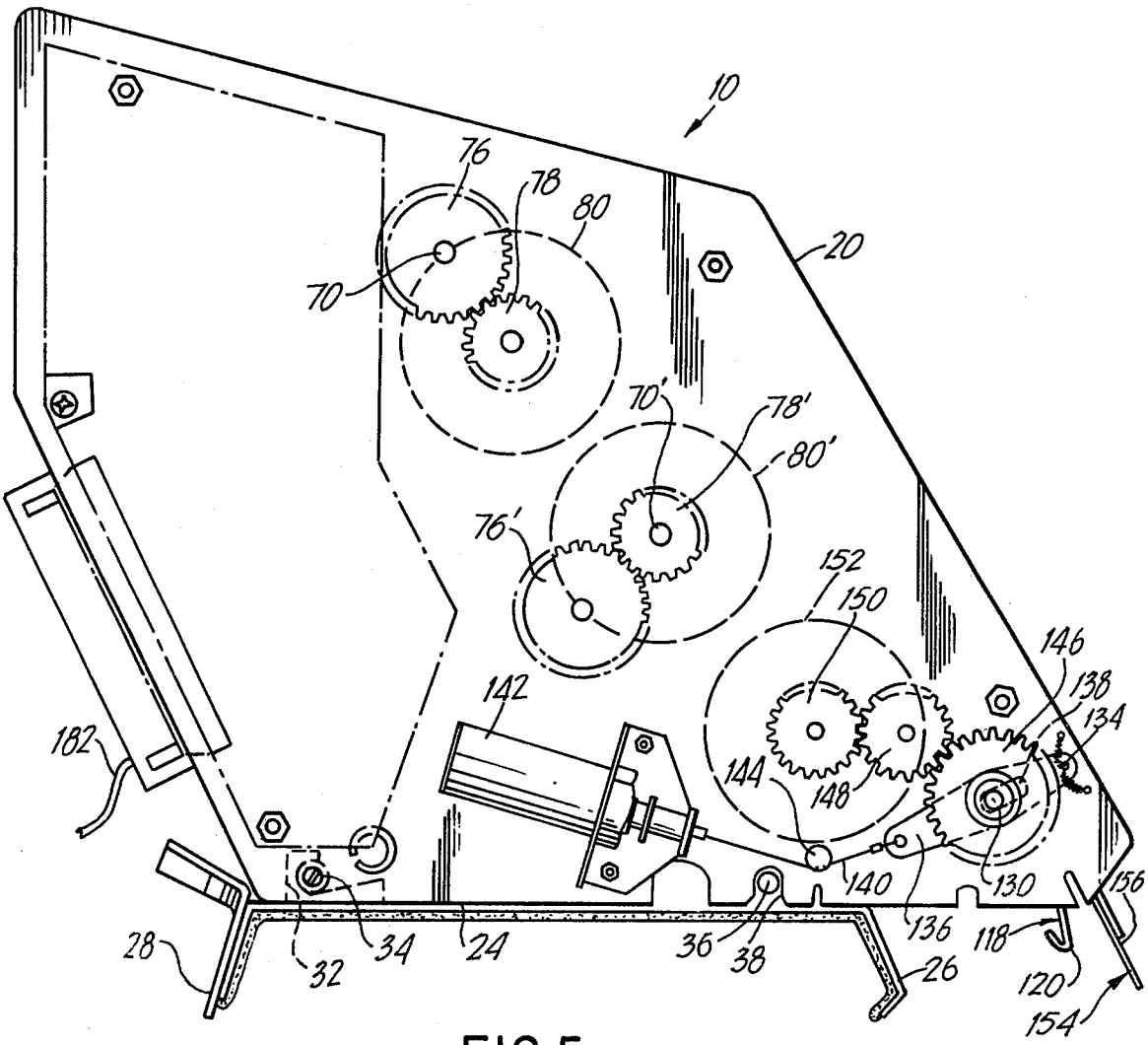
FIG. 5 is a side elevational view of the paper feeding apparatus shown in FIG. 1 with one of the cover plates of the left hand upright housing removed to illustrate the various components therein.

As can best be seen in FIGS. 1, 2 and 5, the ends of the drive rod 70 are journalled in the opposite upright side housings 20, 22. In the side housing 20, the drive rod 70 is provided with an integral drive gear 76 thereon which meshes with a suitable gear 78 attached to the drive shaft of a motor 80 also supported in the upright side housing 20. As will be appreciated, actuation of the motor 80 to rotate in the clockwise direction (as viewed in FIG. 5) serves to drive the gear 78 which in turn drives the gear 76 and the drive rod 70 to rotate the drive rollers 72, 74 about the axis of the drive rod 70. In this regard, the motor 80 is rotated clockwise and the drive rod 70 is rotated in a counterclockwise direction as shown in FIG. 5 so that the drive rollers 72 will engage a sheet of paper 16 and advance same out of the paper tray 44 in a direction substantially parallel to or in the same direction as the direction which the sheets of paper 16 extend, i.e., toward the right and slightly downward as viewed in FIG. 5.

A similar set of rollers 72' and 74', drive rod 70', motor 80' and gears 76', 78' are also provided for the lower paper tray 46. Each of these motors 80, 80' are connected with appropriate circuitry so as to be actuated when desired, as more fully described hereinbelow.

Figure 8:
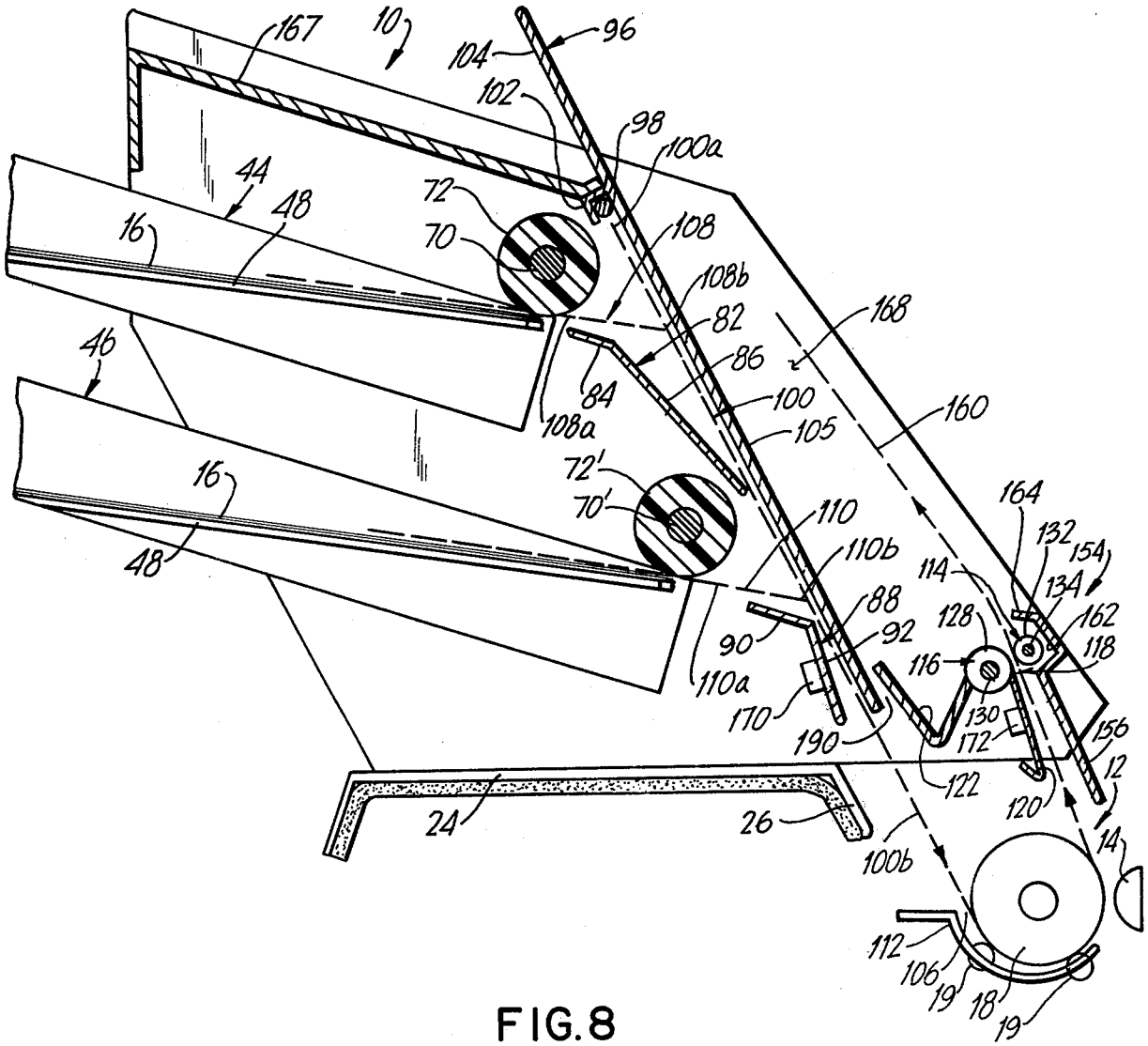
FIG. 8 is schematic side elevational view of the paper feeding apparatus and portion of the printing device thereof illustrating the various paper feed and exit paths for sheets of paper.
Figure 9:
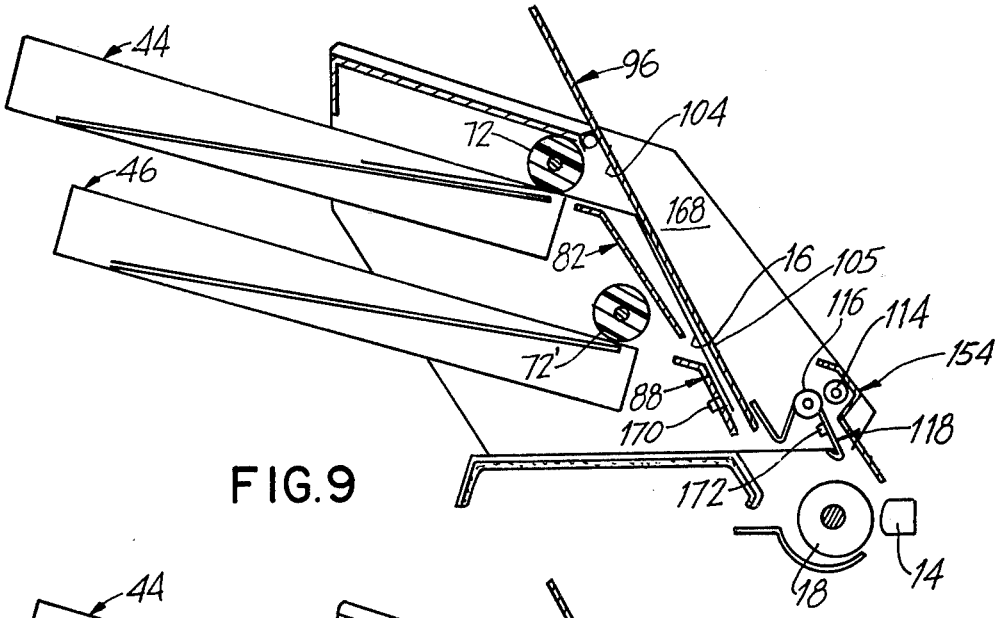
FIG. 9 is side schematic elevational view, similar to that shown in FIG. 8, but on a smaller scale, illustrating a sheet of paper being fed from the upper paper tray and moving past the paper inlet sensor.

Positioned adjacent the upper paper tray 44 and extending between the upright side housings 20, 22, there is provided an upper paper guide plate member 82 having a first upper plate portion 84 closely spaced with respect to the forward end of the paper tray 44 and extending in substantially the same direction as the sheets of paper 16 therein and having a second downwardly inclined portion 86 obliquely oriented with respect to the first upper plate portion 84 (see FIGS. 1, 2 and 8). A similar somewhat shorter lower guide plate member 88 is provided for the lower paper tray 46, and also includes an upper plate portion 90 positioned so that the end thereof is closely spaced from the lower paper tray 46 and extends in substantially the same direction as the paper sheets 16 therein and a downwardly inclined plate portion 92 obliquely oriented with respect to the upper plate portion 90 and extending downwardly towards the lower end of the paper feeding apparatus 10. Each of these guide plate members 82, 88 are supported by suitable fasteners 94 provided in the opposite lateral ends thereof and which are secured to the inner side walls of the side housings 20, 22. The fasteners 94 protrude slightly beyond the surfaces of the plate portions 86, 92 of the guide plate members 82, 88 at the lateral ends thereof.

These guide plate members 82, 88, together with a removable deflector plate 96 define the paper feed path 100 for the sheets of paper 16 which are fed to the paper moving platen 18 of the printing device 12. This paper feed path 100 is shown in dotted outline in FIG. 8. More particularly, the paper deflector plate 96 is removably supported on a transversely extending rod 98 which extends between the side housings 20, 22 at the upper end thereof by means of appropriate hook members 102 provided on the rear surface 104 of the deflector 96. The lower end of the deflector plate 96 is spaced from the guide plate members 82, 88 by means of the protruding fasteners 94 of the lowermost guide plate member 88.

Thus, it is appreciated, especially from viewing FIGS. 8–15, which illustrate the various steps in feeding of paper from the paper feeding apparatus 10 to, through and from the printing device 12, that the lower downwardly extending portions 86, 92 of the guide plate members 82, 88 and the rear surface 104 of the deflector plate 96 define a main paper feed path 100 along which paper may be fed from either of the paper trays 44, 46 to guide the sheets of paper 16 downwardly towards the lower end of the paper feeding apparatus 10 toward the paper moving platen 18. In this regard, it is to be noted that the paper 16, once it is fed into the paper feed path 100 is guided substantially in a straight line to the paper receiving or inlet entrance 106 of the paper moving platen 18 which corresponds with the conventional inlet for inserting paper into the platen 18 of the printing device 12. In other words, the paper feed path 100 for the apparatus is arranged to directly feed paper 16 into the paper receiving inlet 106 of the printing device 12. It will be appreciated that this paper receiving inlet 106 is conventionally arranged at a transverse angle with respect to the upper surface 30 of the printing device 12 and in fact is capable of handling paper sheets oriented at a wide variety of transverse angles with respect to the upper rear surface 30 of the printing device 12. Thus, the orientation of the paper feed path 100 of the paper feeding apparatus 10 of the present invention will serve to precisely guide the sheets of paper 16 fed therealong into the paper receiving inlet 106 for the printing device 12. In this regard, the positioning of the paper feed path 100 relative to the paper receiving inlet 106 of the printing device 12 is achieved by proper positioning of the mounting plate 24 on the printing device 12.

It will also be noted from reviewing FIGS. 8–15, that the sheets of paper 16 which are fed from the paper trays 44, 46 into the paper feed path 100 are initially guided along the respective inlet feed paths 108, 110 (defined by the upper plate portions 84, 90 of the guide plate members 82, 88) at an oblique angle with respect to the direction of the main paper feed path 100 so that the paper will be deflected by the rear surface 104 of the deflector plate 96 downwardly into and along the paper feed path 100. This is true whether a sheet of paper 16 is fed from the upper paper tray 44 (see FIG. 9) or from the lower paper tray 46 (see FIG. 14). Thus, it will be appreciated that whether the paper is being fed from the upper paper tray 44 or the lower paper tray 46, its respective guide plate member 82 or 88, together with the deflector plate member 96 serves to define two paper paths along which paper sheets 16 may move. One path corresponds to the main paper feed path 100 directing paper 16 to the paper moving platen 18 and defined by the lower portions 86 or 92 of the guide plate members 82 or 88 and the rear surface 104 of the deflector plate 96. This paper feed path has an upper end 100*a* and a lower end 100*b*. The other paper paths correspond with the inlet feed paths 108 or 110 for the respective paper trays 44 or 46 for introducing paper into the main paper feed path 100 and are defined by the upper plate portions 84 or 90 of the associated guide plate members 82 or 88. These inlet feed paths 108, 110 each have a first end 108*a*, 110*a*, arranged adjacent the associated paper trays 44, 46, and drive rollers 72, 72′ therefor, and a second end 108*b*, 110*b* arranged adjacent the main paper feed path 100 and intermediate the upper and lower ends 100*a*, 100*b*, thereof.

At the paper receiving inlet 106 of the printing device 12, the paper 16 is guided between the paper moving platen 18 and the paper guide 112 therefor (which generally includes suitable pressure rollers 19) so that upon rotation of the platen 18, the paper 16 will be advanced about the platen 18 and moved past the printing head 14 so as to be in position for effecting printing thereon by movement of the printing head 14 transversely across the platen 18 and by rotation of the platen 18 to advance the paper 16 for different lines of printing. In this regard, it will be noted that the paper 16 is positively fed by the drive rollers 72, 72′ from the associated paper tray 44, 46 into the paper receiving inlet 106 to be received and moved by the platen 18. Once the paper 16 is received by the platen 18. The rotation of the drive rod 70 or 70′ is stopped, and the roller clutch mechanism in the drive rollers 72 or 72′, allows the platen 18 to easily pull the paper from the paper tray 44 or 46 to advance the paper 16 past the print head 14. In this regard, once the paper 16 is in position for printing, the platen 18 may be advanced and moved in accordance with the normal printing instructions or commands for the printing device 12 for effecting printing on the paper 16.

The paper feeding apparatus 10 of the present invention also includes ejection means for ejecting a sheet of paper 16 from the printing device 12 after printing has been effected thereon. In the preferred embodiment, this ejection means comprises a pair of spaced ejection roller means 114, 116 (best seen in FIG. 1 and FIGS. 8–15) which are supported at the forward end of the paper feeding apparatus 10 between the side housings 20, 22 and arranged so as to receive a sheet of paper 16 as it exits from the printing device 12. In this regard, it is to be noted that the sheet of paper 16 is guided between the ejection roller means 114, 116 while printing is being effected thereon, the spacing of the ejection roller means 114, 116 serving to allow the paper 16 to move freely under the control of the platen 18. When it is desired to eject a sheet of paper 16 after the printing has been completed, the forward ejection roller means 114 is moved towards the rear ejection roller means 116 to grippingly engage a sheet of paper 16. The ejection roller means 114, 116 are then rotated to pull the sheet of paper 16 upwardly away from the printing device 12 and to stack same against the front surface 105 of the deflection plate 96.

More particularly, at the forward end of the side housings 20, 22, there is provided an exit guide plate member 118 having a front surface 120 inclined downwardly and adapted to lie just above the rotatable platen 18 of the printing device 12 adjacent the exit end thereof for a sheet of paper 16 and having a rearwardly inclined V-shaped surface 122 which serves to support the lower edges of the ejected sheets of paper 16. The forward upper end of the V-shaped surface 122 is integral with the front surface 120 at 124 to provide a smooth transition therebetween, and the rearward end of the V-shaped surface 122 is arranged in close spaced relationship with the lower end of the deflector plate 96, as can best be seen in FIG. 8. A curved corner or bend 124 between the V-shaped surface 122 and the front surface 120 of the exit guide plate member 118 is provided having transversely extending openings 126 therein for receipt of a pair of spaced roller members 128 which comprise the ejector roller means 116. As can best be seen in FIGS. 1 and 8, these rear ejector rollers 128 are fixedly connected to a transversely extending shaft 130 which is journalled in the upright side housings 20, 22. The other ejector roller means 114 similarly comprise a pair of forward spaced roller members 132 affixed to a transversely extending shaft 134 mounted in the side housings 20, 22, the forward roller members 132 being arranged directly opposite from the rear roller members 128.

The ends of the forward transversely extending shaft 134 in the side housings 20, 22 are journalled in a plate member 136 supported in the side housings 20, 22, for movement to move the forward roller members 132 into engagement with the rear roller members 128. As best seen in FIG. 5, the movable plate members 136 are spring biased to normally maintain the forward roller members 132 in spaced relationship with respect to the rear roller members 128 in order to provide a space for a sheet of paper 16 to freely move therebetween. The movable plate members 136 each include a slot 138 therein through which the transversely extending shaft 130 for the rear roller members 128 pass. The rearward end of the movable plate members 136 are each provided with a cable 140 which is connected to retractable solenoid members 142 fixedly mounted in brackets in each of the upright side housings 20, 22. These cables 140 connected to the solenoid members 142 and the movable plate members 136 each pass about a transversely extending sleeve 144 mounted in the side housings 20, 22. Simultaneous retraction of the solenoid members in the side housings 20, 22 serves to pull the plate members 136 rearwardly to thereby move the forward ejection roller members 132 into engagement with the rear ejection roller members 128. The extent of travel of the plate members 136 and thus the forward roller members 132 may be limited by the length of the longitudinal slot provided in the plate members 136, or alternatively by the engagement of the forward ejection rollers 132 with the rear ejection rollers 128.

The transversely extending rear shaft 130 is provided at one end (the left hand end as viewed in FIG. 1) with a rotatable gear 146 fixedly mounted thereto and in meshing engagement with a second gear 148 rotatably supported on the wall of the upright side housing 20. This second gear member 148 in turn is in meshing engagement with a gear 150 fixed to the drive shaft of an ejection motor 152 mounted in the upright side housing 20. Actuation of the ejection motor 152 thus causes the second gear 150 to rotate to in turn rotate the rear ejection shaft 130 to drive the rear ejection rollers 128 in a counterclockwise direction as viewed in FIG. 5. As can be appreciated, when the forward ejection rollers 132 are moved into engagement with the rear ejection rollers 128 and the rear ejection rollers 128 rotated by the ejection motor 152, the forward and rear ejection rollers 132, 128 will grippingly engage a sheet of paper 16 therebetween and rotate in opposite directions to pull the paper 16 away from the printing device 12 and move same upwardly (see FIG. 12). This upward movement of the sheet of paper 16 will continue until the paper 16 is ejected from the rollers 128, 132, at which time it will fall backwardly and downwardly (as viewed in FIGS. 8–15) to rest in a receptacle 168 therefor defined by the lower end of the V-shaped surface 122 of the exit guide plate member 118 and the forward surface 105 of the deflector plate 96 (see FIG. 13). As the sheets of paper 16 are ejected from the printing device 12, the sheets 16 will thus be stacked against the deflector plate 96 with the lower ends thereof resting in the V-shaped surface 122 of the exit guide plate member 118 (see FIG. 13).

The paper feeding apparatus 10 is also provided with a removable forward cover member 154 which defines with the forward surface 120 of the exit guide plate member 118 an exit path of movement 160 (see FIG. 8) for guiding the sheets of paper 16 as they leave the platen 18 upwardly between the normally spaced ejection rollers 128, 132. For this purpose, the cover member 154 includes a downwardly extending plate portion 156 which is slightly inclined with respect to the forward surface 120 of the exit guide plate member 118 to provide a relatively large entrance which tapers toward the ejection rollers 128, 132. The lower front surface 156 of the cover member 154 also serves as a stop or rest for the paper rollers 158 of the printing device 12 which normally serve to direct the paper 16 away from the print head 14. The cover 154 also includes a recessed portion 162 for the forward ejection rollers 132 and the mounting shaft 134, and an upper deflection surface 164 for directing the sheet of paper 16 rearwardly towards the deflector plate 96. The cover member 154 may also be provided with upwardly extending tab portions 166 extending from the inner surface of the lower forward end portion 156 for ensuring that the paper 16 is guided between the ejector rollers 128, 132 and does not engage the support shaft 134 for the forward ejection rollers 132 (see FIG. 1).

The paper feeding apparatus 10 of the present invention also includes a pair of paper movement sensors 170, 172 for sensing when a sheet of paper 16 is being moved therepast. Each of these sensors 170, 172 is of the photoelectrical reflective type which transmits a beam of light and which includes means for receiving the reflected light to close the sensor 170, 172. Thus, when a sheet of paper 16 is moved in front of each of the sensors 170, 172, the paper 16 will serve to reflect and direct the projected light back to the sensor 170, 172 which detects same and closes the sensors 170, 172.

The first paper movement sensor 170 is mounted in the lower paper guide plate member 88 adjacent the lower end of the paper feed path 100. This sensor 170 serves to detect if and when a sheet of paper 16 is moved therepast in order to signal the controller to actuate the platen 18 for rotation to receive a sheet of paper 16 fed from one of the paper trays 44 or 46. The second paper movement sensor 172 is located in the outlet or exit path 160 of movement of a sheet of paper 16 in the front surface 120 of the exit guide plate member 118 for detecting when a sheet of paper 16 has been picked up by the platen 18 and is being moved thereby in the path 160. This sensor 172 also serves to provide a reference point used in the positioning of the sheet of paper 16 in a proper print position relative to the printing head 14. Each of the sensors 170, 172 are centrally located with respect to the longitudinal center line of the paper feeding apparatus 10 so that they will be operable with respect to all widths of paper which may be utilized in the paper feeding apparatus 10.

The paper feeding apparatus 10 further includes paper tray sensors 174, 176 for sensing when the paper trays 44, 46 are out of paper. These sensors, 174, 176, one for the upper tray 44 and one for the lower tray 46, are mounted on the underside of either the top support plate 167 or the upper paper tray plate member 54. Each of these tray sensors 174, 176 includes a cantilevered movable switch actuator 178 which is directed towards its respective paper tray 44, 46 and engages a sheet of paper 16 when paper is in the tray 44, 46. The paper support plates 48 in the paper trays 44, 46 are each provided with a slot 180 therein in alignment with the switch actuators 178 of the respective sensors 174, 176. Each of the tray sensors 174, 176 are open when the switch actuators 178 are raised and are closed when the switch actuators 178 are lowered, the actuators 178 being biased toward the lowered position. As long as a sheet of paper 16 is in the paper tray 44 or 46 on top of the paper support plate 48 (which is biased upwardly by the roller elements 60) the actuators 178 will be in the raised position. However, when the last sheet of paper 16 is removed from the paper tray, 44 or 46, or when the paper tray release lever 66 is depressed or the paper tray 44, 46 has been removed, there will be no sheet of paper or other means for maintaining the switch actuators 178 in the raised position and the actuators 178 will thus move into its lower position, thereby providing an indication that no paper is available for feeding to the printing device 12.

The operation of the paper feeding apparatus 10 will now be described.

Initially, the paper feeding apparatus 10 is mounted to the upper rear surface 30 of a printing device 12 with the paper feed path 100 being aligned with the inlet 106 to the paper platen 18 and with the paper exit path 160 being aligned with the exit end of the platen 18. If a conventionally used cylindrical platen 18 is provided in the printing device 12, the spacing between the paper feed path 100 and the paper exit path 100 in the paper feeding apparatus 10 will substantially correspond to the diameter of the platen 18. This mounting of the paper feeding apparatus 10 is accomplished by inserting the rear transversely extending bar 34 into the hook members 32 of the mounting plate 24, previously mounted to the printer device 12, and then tilting the paper feeding apparatus 10 downwardly while depressing the locking button 42 to receive the forward transverse bar 36 on the mounting plate 24. The locking button 42 is then released to secure and lock the paper feeding apparatus 10 in place on the mounting plate 24. The paper feeding apparatus 10 is then connected electronically to the printer device 12 via a suitable electrical connection device and cable 182. The electrical section of the paper feeding apparatus 10 includes a microprocessor, an interface and a cable 182. The microprocessor essentially serves to control the operation of the paper feeding apparatus 10 during feeding as well as to cooperatively control movement of the platen 18 and printing head 14 to the extent necessary for proper feeding of sheets of paper 16 and moving the same into proper positioning for printing. In this regard, to the extent that the paper feeding apparatus 10 controls operation of the platen 18 and print head 14 of the printer device 12, the paper feeding apparatus 10 uses the conventional codes or commands used by a printing device 12 via the control circuitry therefor. The information respecting these codes or commands, as available from the printer interface and as used herein, are set forth in the Interface Manual which, in the instance of the exemplary embodiment which is used in conjunction with a Lanier "No Problem" word processing unit, is published by Lanier Business Products.

The paper feeding apparatus 10 permits the automatic loading of sheets of paper 16 into the printing device 12 for printing thereon either from commands located in the text being processed by the printing device 12 or by operator selection through a control panel 184 located in the front of the paper feeding apparatus 10. Thus, in this latter regard, the paper feeding apparatus 10 may be used to feed sheets 16 automatically to the printing device 12 and print any previously created text that is stored on a disk or in the word processing unit without any additional commands for controlling operation of the paper feeding apparatus 10 being made to the text.

The control panel 184 in the preferred embodiment consists of four switches **186*a–d* and five lights 188*a–e*. Four of the lights 188*a–d* are mounted on the switches 186*a–d* and the remaining light 188*e* is located on the top of the panel 184 to provide an indication that the power is on for the printing device 12. In this regard, this power on light 188*e* indicates that the paper feeding apparatus 10 is connected to the printer device 12 and has power. Under normal operation, only the power light 188*e* will be on and the other four lights 188*a–d* will be off. One of the switches and lights, for example, the upper switch 186*a* and light 188*a*, are for resetting the operation of the paper feeding apparatus 10 and to indicate that there is a fault. The second switch 186*b* may for example control feeding of paper 16 from the upper paper tray 44 and, when the light 188*b* is lit, to indicate that the tray 44 is empty. Similarly, the third switch 186*c* is for controlling feeding from the lower paper tray 46 and the light 188*c* serves to indicate when the lower tray 44 is empty. The fourth switch 186*d* may provide control of the mode of operation of the paper feeding apparatus 10, to be described more fully hereinbelow, with the light 188*d* indicating that the feeding apparatus 10** is in the manual mode of operation.

Figure 16A:
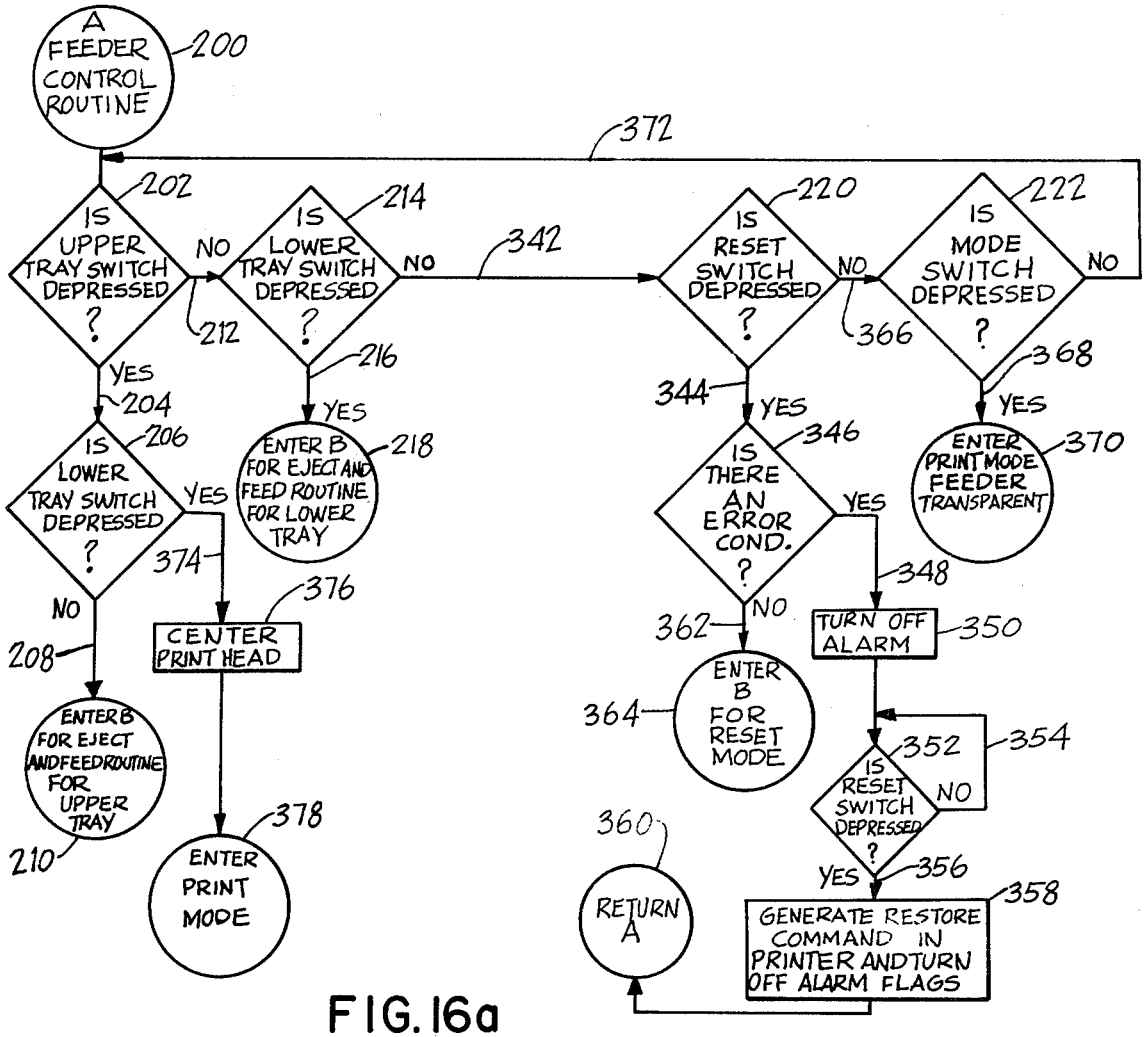
FIGS. 16*a* and 16*b* are schematic flow charts illustrating the algorithm for controlling operation of the paper feeding apparatus in accordance with the present invention.
Figure 16B:
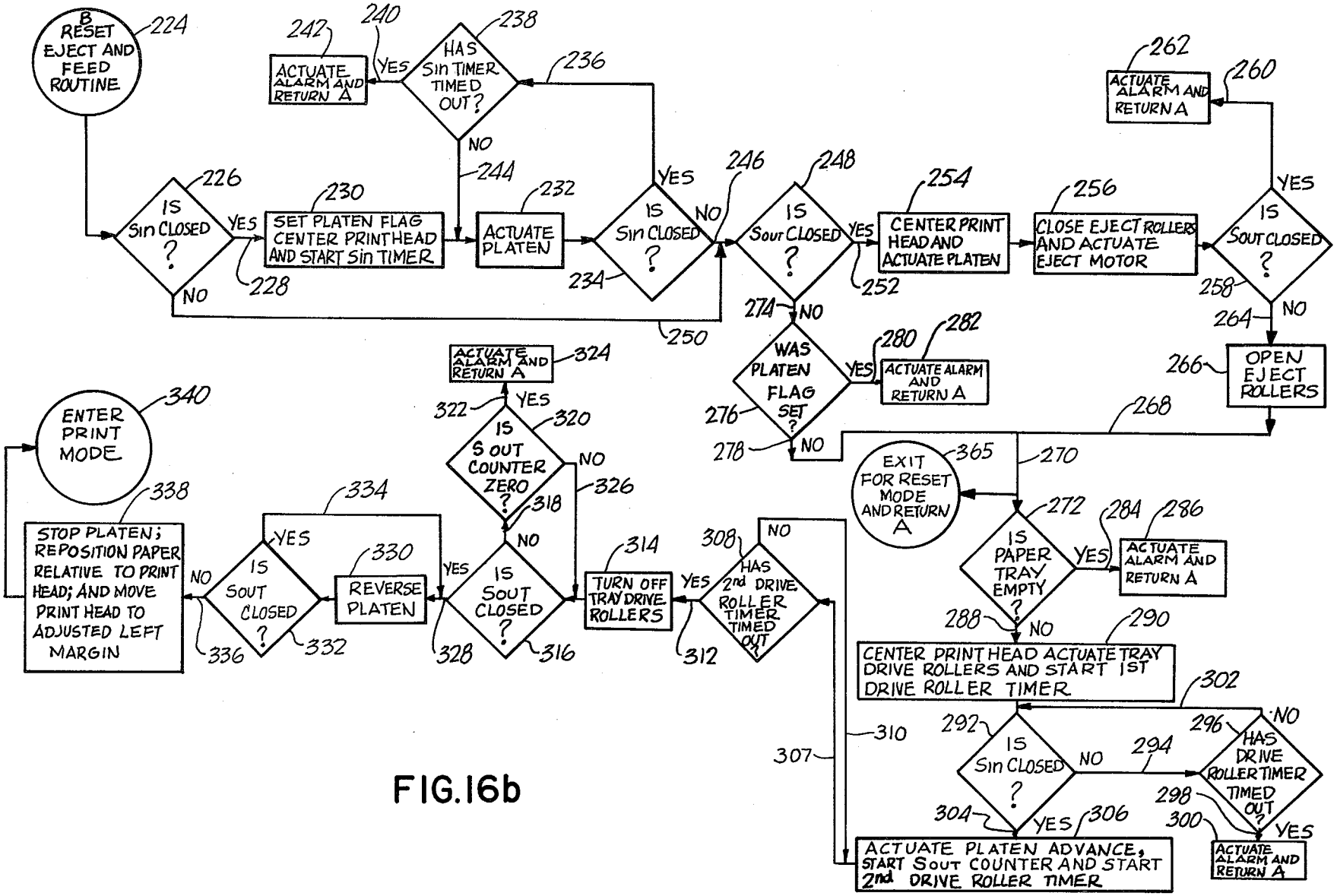

The actual processing which takes place during operation of the paper feeding apparatus 10 according to the present invention may best be appreciated upon a detailed review of the annotated program listing which may be found in the file wrapper of the application as Appendix A; however, in order to provide the reader with an overall view of the processing which takes place under program control, the flow charts set forth in FIGS. 16*a* and 16*b* are provided and will be hereinafter discussed so that the manner in which the paper feeding apparatus 10 operates and implements basic functions may be readily understood. It should be noted however, that the flow charts which are hereinafter discussed are simplified to a great degree, consistent with the usage of flow charts as relied upon by those of ordinary skill in the art, and hence, reference to Appendix A should be made for precise details of the particular program described or otherwise employed. In essence, the flow charts of FIGS. 16*a* and 16*b* illustrate the implementation of the basic algorithm for the microprocessor in the control vicinity of the paper feeding apparatus 10. The operation of the paper feeding apparatus 10, by means of operator selection through the control panel 184, will now be described with reference to FIGS. 16*a* and 16*b*.

When it is desired to print stored text onto a sheet of paper 16, the paper feeding apparatus 10 is activated to enter the Feeder Control Routine A (as indicated by the circular flag 200 and labeled "Feeder Control Routine" in FIG. 16*a*) by depressing the appropriate paper tray switch 186*b* or 186*c* for either the upper or lower paper trays 44, 46 to select the appropriate size of the paper 16 upon which printing will occur. The paper feeding apparatus 10 initially tests to ascertain which switch 186*b* or 186*c* is depressed. Assuming that only one of the tray switches 186*a* or 186*b* is depressed (the other operations depicted in FIG. 16*a* will be described later), the paper feeding apparatus 10 enters the Reset, Eject and Feed Routine B (illustrated in FIG. 16*b*, labeled as circular flag 224) for the selected tray 44, 46.

More specifically, the paper feeding apparatus 10 initially tests to determine if the upper tray switch 186*b* is depressed as indicated by the diamond 202. This is done by testing the open or closed condition of switch 186*b*. If the tray switch 186*b* is depressed, the state of the lower tray switch 186*c* is tested to determine if the lower tray switch 186*c* is also depressed, as indicated by the arrow 204 and diamond 206. (The operation of the system when both tray switches 186*b* and 186*c* are depressed together will be described hereinbelow; at the present time, it is assumed that only the upper tray switch 186*b* is depressed.) If the test of the lower tray switch 186*c* (as indicated by the diamond 206) is negative, the Reset, Eject, and Feed Routine B is entered for the upper tray 44, as indicated by the arrow 208 and the circular flag 210. If the upper tray switch 186*b* is not depressed, the lower tray switch 186*c* is then checked, as indicated by the arrow 212 and diamond 214. If the lower tray switch 186*c* is depressed, the Reset, Eject and Feed Routine B is entered for the lower paper tray 46 (as indicated by the arrow 216 and circular flag 218). If the lower tray switch 186*c* is not depressed, the paper feeding apparatus 10 then tests whether the reset switch 186*a* has been depressed, or whether the mode switch 186*d* has been depressed, as indicated by the diamonds 220 and 222. These tests and the operation effected as a result thereof will be described more fully hereinbelow. Although not shown, the depressing of the upper or lower paper tray switches 186*b* or 186*c* also sets a tray flag, which may typically comprise a flip-flop, to indicate which tray has been selected so that during the Reset, Eject and Feed Routine, paper will be fed from the appropriate paper storage tray 44, 46. Thus, it will be appreciated that the paper feeding apparatus 10 may be activated by depressing either of the switches 186*b* or 186*c* to set the appropriate flag and enter the Reset, Eject and Feed Routine for either the upper paper tray 44 or the lower paper tray 46.

As the Reset, Eject and Feed Routine is essentially the same whether the upper tray switch 186*b* is depressed or the lower tray switch 186*c* is depressed, the flow diagram of FIG. 16*b* will be described with reference to the upper tray switch 186*b* having been depressed.

When the Reset, Eject and Feed Routine B (indicated by the circular flag 224, in FIG. 16*b*) is initially entered for the paper tray 44, the paper feeding apparatus 10 automatically checks to determine if any paper 16 is left in the printing device 12. This is accomplished as indicated by the diamond 226 and is implemented by checking whether or not the paper inlet sensor $S_{in}$ is in an open or closed condition. The inlet sensor $S_{in}$ corresponds to paper movement sensor 170, and thus the determination of whether the inlet sensor $S_{in}$ is closed or open corresponds to a detection of an output from the receptor portion of the sensor 170 corresponding to the receipt of light as reflected by a sheet of paper 16 on the back of the paper movement sensor 170 (in which case the inlet sensor $S_{in}$ is closed) or whether no light is received (in which case the inlet sensor $S_{in}$ is open). If paper inlet sensor $S_{in}$ is closed, as indicated by the arrow 228 and the rectangle 230, the print head 14 and its associated guide member 15 are centered transversely with respect to the platen 18, a platen flag is set, and then a $S_{in}$ timer is started. The print head 14 and guide member 15 are centered to ensure that the sheet of paper 16 in the printer device 12 will be guided along the exit path of movement 160, as more fully described hereinbelow. The setting of the platen flag and the start of the $S_{in}$ timer are for the purpose, respectively, of indicating that the inlet sensor $S_{in}$ was initially closed (i.e., paper was initially in front of the inlet sensor $S_{in}$ (170) when a new sheet of paper was called for), and to start a timer which will serve to actuate an alarm within a predetermined time if the inlet sensor $S_{in}$ is not cleared. The platen flag may typically comprise a flip-flop and the $S_{in}$ timer may typically comprise a counter driven from the system clock or divisions thereof. After centering of the print head 14 has been initiated together with a setting of the platen flag and a starting of the $S_{in}$ timer, the platen 18 is actuated (as indicated by the rectangle 232) to drive paper 16 in the forward paper feed direction for a predetermined number of increments, corresponding for example to a distance of ½ inch per step.

The centering of the print head 14 and its associated guide member 15, as well as the advance of the platen 18 is accomplished in the preferred embodiment by utilizing the conventional printing device 12 commands as normally provided by the system to the printer. For example, this can be accomplished by generation of an appropriate signal which corresponds to the signal used by the printing device 12 for actuating the platen advance motor and the print head carriage motor. In this regard, it is to be noted that these conventional commands can be utilized since the paper feeding apparatus 10 is electrically connected and coupled with the control unit for the printing device 12.

After the platen 18 has advanced the predetermined number of increments, the paper feeding apparatus 10 again tests to determine whether the inlet sensor $S_{in}$ (170) is still closed, as indicated by the diamond 234. If the inlet sensor $S_{in}$ is still closed, the $S_{in}$ timer is then checked to determine if it has timed out, as indicated by the arrow 236 and the diamond 238. If the $S_{in}$ timer has timed out, an appropriate alarm is actuated and returns to the Feeder Control Routine A so the alarm may be deactivated (as described hereinbelow), as indicated by the arrow 240 and the rectangle 242. The alarm for example may comprise a switchable buzzer or bell and/or a light. In the preferred embodiment, this alarm comprises both a bell (not shown) and a light 188*a*. The timing period for the $S_{in}$ timer should be chosen to be sufficiently long to permit a sheet of paper 16 blocking the sensor $S_{in}$ to be cleared from the sensor $S_{in}$ by movement of the paper 16 by the platen 18. If the $S_{in}$ timer has not timed out, the platen 18 is again advanced, as indicated by the arrow 244 and rectangle 232. This operation of advancing the platen 18, checking the inlet sensor $S_{in}$ and the timer $S_{in}$ is continually repeated until the inlet sensor $S_{in}$ opens to indicate that paper 16 has been cleared from in front of the inlet sensor $S_{in}$, or the $S_{in}$ timer times out. Assuming that the inlet sensor $S_{in}$ opens before the $S_{in}$ timer times out, (as indicated by the arrow 246), the paper feeding apparatus 10 then proceeds to determine whether the outlet sensor $S_{out}$, corresponding to the paper movement sensor 172, is closed or open as indicated by the diamond 248. Similarly, if the inlet sensor $S_{in}$ is initially opened (corresponding to no paper being in front of the input sensor $S_{in}$ (170)), the outlet sensor $S_{out}$ will then be tested, as indicated by the arrows 250, 246 and diamond 248.

If the outlet sensor $S_{out}$ is closed (corresponding to the paper 16 being in front of the paper movement sensor 172) as indicated by the arrow 252, the paper feeding apparatus 10 is operated to eject paper 16 from the printing device 12. More specifically, after the outlet $S_{out}$ is sensed as being closed, the print head 14 is centered and the platen 18 is actuated a predetermined number increments to ensure that the paper 16 in the printing device 12 is free from the platen 18, as indicated by the rectangle 254. In this regard, if the print head 14 has already been centered (in the operation serving to clear the inlet sensor $S_{in}$, indicated by the rectangle 230), the signal for centering the print head 14 would not cause any additional motion. The operation of advancing the platen 18, indicated by the rectangle 254, is again accomplished by generating a signal utilizing the conventional commands for the printing device 12 to rotate the platen 18 a sufficient number of increments to move the trailing edge of the paper 16 to the exit end of the platen 18. The number of increments for example would correspond to the distance from the inlet sensor $S_{in}$ (170) to the exit from the platen 18 (since it is known that prior to this advance of the platen 18 the trailing edge of the paper 16 is clear of the inlet sensor $S_{in}$).

Next, as indicated by the rectangle 256, the ejection solenoids 142 are actuated to move the ejection rollers 128, 132 into engagement with one another, and then the ejection motor 152 actuated to drive the ejection rollers 128, 132 to pull the sheet of paper 16 out of the printing device 12 and to stack the same in the paper outlet hopper or receptacle 168. The ejection motor 152 typically may comprise a stepping motor which is actuated for a specified number of steps and is then turned off. The number of steps should be sufficient to move the trailing edge of the sheet of paper 16 through the ejection rollers 128, 132. This would correspond to moving the paper 16 a distance at least as great as the distance from the exit of the platen 18 to the ejection rollers 128, 132, as the platen 18 was previously advanced (as indicated by the rectangle 254) to move the trailing edge of the paper 16 to the exit for the platen 18. After the ejection motor 152 is actuated, the outlet sensor $S_{out}$ (172) is again tested as indicated by the diamond 258. If the outlet sensor $S_{out}$ is closed, an alarm is sounded and the light 188*a* is lit, as indicated by the arrow 260 and rectangle 262, and then returns to the Feeder Control Routine A (200). This condition would correspond to a paper jam since actuation of the ejection motor 152 for the predetermined number of steps should have cleared the outlet sensor $S_{out}$.

If the output sensor $S_{out}$ is open, the ejection solenoids 142 are deactivated to open the space between the ejection rollers 128, 132, as indicated by the arrow 264 and rectangle 266. After this operation, the paper feeding apparatus 10 proceeds to the line 268 to eventually check whether the upper paper tray 44 is empty (since the upper paper tray 44 was initially selected from which to feed paper 16), as indicated by the arrow 270 and diamond 272.

Alternatively, if the outlet sensor $S_{out}$ was opened when it was initially tested, as indicated by the diamond 248 (i.e., no paper 16 was in front of the sensor 172), the paper feeding apparatus 10 will test whether the platen flag was set, as indicated by the arrow 274 and diamond 276. This test serves to determine whether the inlet sensor $S_{in}$ was initially closed or opened when the Reset, Eject and Feed Routine B was entered. If the platen flag was not set (corresponding to the condition of the inlet sensor $S_{in}$ having been initially open) the paper feeding apparatus 10 proceeds, as indicated by the arrow 278, to the line 268 to subsequently test whether the upper paper tray 44 is empty, as indicated by the arrow 270 and diamond 272. On the other hand, if the platen flag was set (indicating that paper 16 was in front of the inlet sensor $S_{in}$ initially), an alarm is sounded and the light 186*a* lit, as indicated by the arrow 280 and rectangle 282, and returns to the Feeder Control Routine A (200). Here it should be noted that the test of whether the platen flag was set (at the diamond 276) would only be made if the outlet sensor $S_{out}$ were initially open when tested at the diamond 248. Thus, it will be appreciated that an alarm would be actuated only if the inlet sensor $S_{in}$ were initially closed and, after $S_{in}$ is opened, the outlet sensor $S_{out}$ is initially open. This would indicate that the paper initially blocking the inlet sensor $S_{in}$ jammed in the printer 12 before reaching the outlet sensor $S_{out}$. Conversely, if the inlet sensor $S_{in}$ was initially open (i.e., no paper 16 in the paper feed path 100) the paper feeding apparatus 10 would proceed along arrow 250 to test the condition of the outlet sensor $S_{out}$ and the platen flag would not be set. If the outlet sensor $S_{out}$ is also open initially (indicating that no paper is in the exit path 160), the test for the platen flag, at the diamond 276 would be negative, as indicated by the arrow 278, and the paper feeding apparatus 10 would proceed to test the upper paper tray 44 for paper, as indicated by the line 268, the arrow 270 and the diamond 272.

If the paper feeding apparatus 10 has not jammed and the printer 12 is clear of paper, the paper feeding apparatus 10 proceeds to test whether the selected paper tray (i.e., the upper tray 44 in this example) is empty, as indicated by the diamond 272. In this determination, if the selected paper tray 44 is empty, an appropriate alarm is actuated, as indicated by the arrow 284 and the rectangle 286, and the paper feeding apparatus 10 returns to the Routine A (200). In the preferred embodiment this alarm comprises lighting the paper tray empty light **188*b* and sounding a bell or buzzer to alert the operator. If the paper tray 44 is not empty, as indicated by the arrow 288, the paper feeding apparatus 10 then generates a signal to center the print head 14 transversely with respect to the platen 18, again by utilizing the conventional commands for the printing device 12 for movement of the print head carriage, as indicated by the rectangle 290. If the print head 14 has already been centered (as in the ejecting part of the routine B as indicated by the rectangle 230 or the rectangle 254), this signal will simply be ignored. Also, at this time, as indicated by the rectangle 290, the appropriate tray drive rollers 72 are activated by actuation of the associated drive motor 80 to feed a single sheet of paper 16 from the paper tray 44 forward along the paper inlet path 108 into the main paper feed path 100. When the associated drive motor 80 is actuated, a first drive roller interval timer is also started, as indicated by the rectangle 290. This timer may be similar to the $S_{in}$ timer and performs a similar function with respect to the time of operation of the tray drive rollers 72. As the sheet of paper 16 is fed from the paper tray 44 along the paper inlet path 108 into the main paper feed path 100, the leading edge of the paper 16 strikes the deflector plate 96 and is directed downwardly along the main paper feed path 100. The paper travels in a relatively straight line path towards the platen 18 and past the paper input sensor 170 (see also FIG. 9**).

The next operation is to test the inlet sensor $S_{in}$ (170) to determine if it is closed. If the paper inlet sensor $S_{in}$ (170) does not close within a predetermined time after actuation of the tray drive motor 80, a fault alarm is sounded and the fault light **188*a* is lit on the paper feeding apparatus 10, to indicate that the paper 16 has not been fed from the paper tray 44, or that the paper 16 has jammed in the inlet feed path 108 or in the main paper feed path 100. This is accomplished by testing the inlet sensor $S_{in}$ to determine whether or not it is closed, as indicated by the diamond 292. If the inlet sensor $S_{in}$ is not closed, a test is made as to whether the first drive roller timer has timed out, as indicated by the arrow 294 and diamond 296. If the first drive roller timer has timed out, the alarms are actuated, as indicated by the arrow 298 and rectangle 300, and the paper feeding apparatus 10 returns to the Routine A (200). If the first drive roller timer has not timed out, the paper feeding apparatus 10 again tests the inlet sensor $S_{in}$ to determine whether it is closed, as indicated by the arrow 302 and the diamond 292. This loop is continued until either the inlet sensor $S_{in}$ is closed or the first drive roller timer has timed out. The interval or timing period for the first drive roller timer is chosen to allow a sufficient time for paper 16 to be fed from the tray 44 past the inlet sensor Sin (170**) if the paper has not jammed.

If the inlet sensor $S_{in}$ (170) closes within the predetermined period of time alotted by the first drive roller timer, the the platen drive motor is actuated to begin driving the platen 18 for receipt of the sheet of paper 16 being fed along the main paper feed path 100, as indicated by the arrow 304 and the rectangle 306. This actuation of the platen 18 takes place a predetermined time after the leading edge of the sheet of paper 16 being fed passes the paper inlet sensor 170. In this regard, it should be noted that the platen 18 is driven at a slower rate of speed than the speed at which the paper 16 is fed by the tray drive motor 80 to ensure a positive feeding of the sheet of paper 16 into the platen 18. Also, when the platen 18 is actuated, an outlet sensor counter ($S_{out}$ counter) and a second drive roller timer are started, as indicated by the rectangle 306. The $S_{out}$ counter is decremented each time the platen 18 is advanced and should be set at an initial state corresponding to the number of discrete steps of the platen 18 with which the outlet sensor $S_{out}$ should close if the paper 16 is being properly moved by the platen 18. The second drive roller timer is similar to the $S_{in}$, and first drive roller timers, and serves to define a predetermined period of time after which the drive rollers 72 should be turned off. This timing interval should provide a sufficient time or number of steps to permit the leading edges of the paper 16 to advance from the inlet sensor $S_{in}$ into the inlet 106 for the platen 18.

Next, the paper feeding apparatus 10 determines whether the second drive roller timer has timed out, as indicated by the arrow 307 and diamond 308. This test is continually repeated, as indicated by the arrow 310, until the second drive roller timer has timed out. When the second drive roller timer has timed out, as indicated by the arrow 312, the tray drive rollers 72 are turned off, as indicated by the rectangle 314. When the tray drive rollers 72 have been turned off, the paper 16 will be advanced solely by means of the platen 18. In this regard, it will be noted that the drive rollers 72 are provided with a roller clutch so that the drive rollers 72 may freely rotate in the counterclockwise direction relative to the drive shaft 70, as viewed in FIGS. 8–15.

Once the paper 16 is fed into the platen 18, it will be advanced around the platen 18 to move past the print head 14 and associated guide member 15 of the printing device 12 and be directed along the paper exit path 160. In this regard, it will be recalled that the print head 14 and associated guide member 15 thereon were previously centered with respect to the transverse center of the platen 18 (see rectangles 230, 254, 290), and thus with respect to the longitudinal center line of the paper 16 being advanced. The paper guide member 15 serves to deflect a sheet of paper 16 being advanced therepast directly into alignment with the paper exit path 160 between the lower plate portion 156 of the cover 154 and the lower front surface 120 as the exit guide plate member 118. The paper guide member 15 is a conventional element of typewriters and printers, and has a transverse width which normally serves to deflect the paper being fed therepast in the rearward direction on the platen 18 so that the paper will not fall back over the print head 14. The alignment of the print head 14 and guide member 15 in the center of the platen 18 is preferably accomplished before the tray drive rollers 72 are actuated (see rectangle 290), although it may be accomplished any time prior to a sheet of paper 16 being received by the platen 18.

Thus, it will be appreciated that in this manner, the guide member 15 and the printing head 14 are employed as a deflection member to ensure proper feeding of the paper 16 along the desired exit path 160. More specifically, the centering of the guide member 15 with respect to the platen 18 serves to properly direct and guide the paper 16 along the exit paper path 160, which might not otherwise be the case if the print head 14 and paper guide member 15 were located at one of the margins of the paper 16 or if no guide member 15 were provided.

Figure 10:
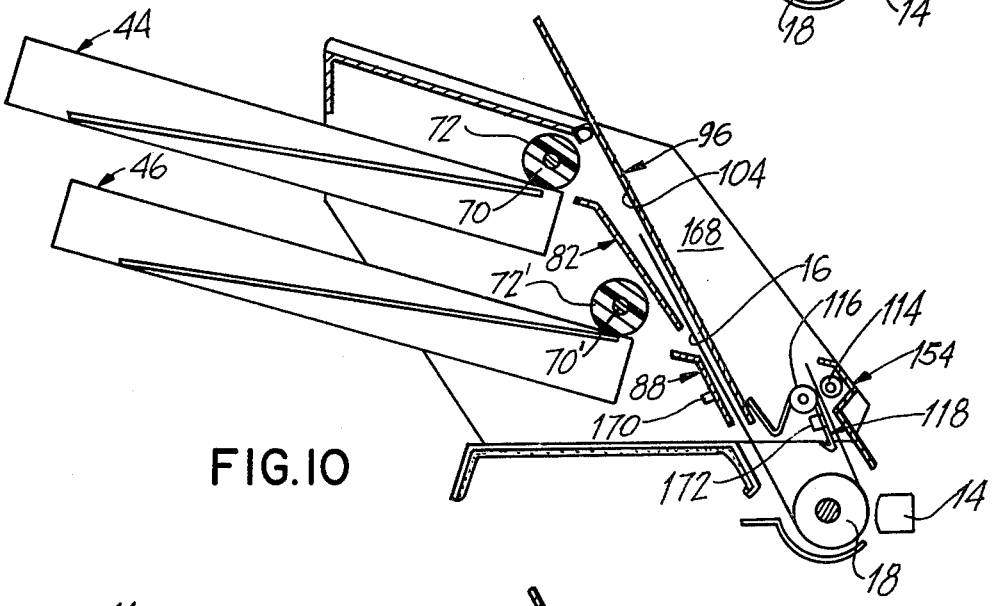
FIG. 10 is a schematic side elevational view, similar to that shown in FIG. 9, illustrating a sheet of paper being moved by the platen of the printing device with the leading edge thereof being positioned in front of the outlet sensor in the exit path of movement for the paper.
Figure 11:
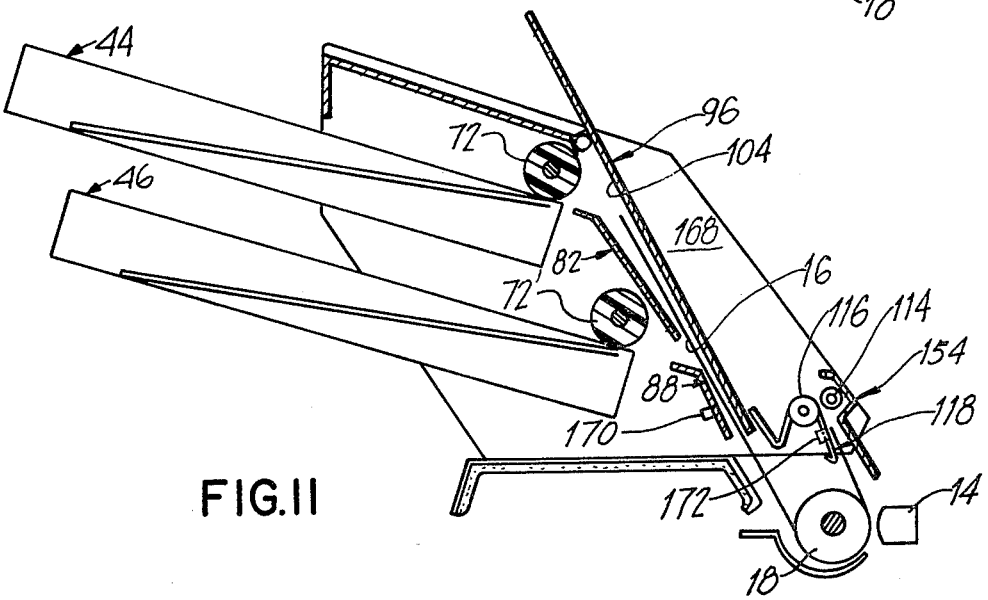
FIG. 11 is a schematic side elevational view, similar to that shown in FIG. 9, illustrating a sheet of paper positioned relative to the paper platen with the leading edge aligned with the outlet sensor in the paper exit path of movement.
Figure 12:
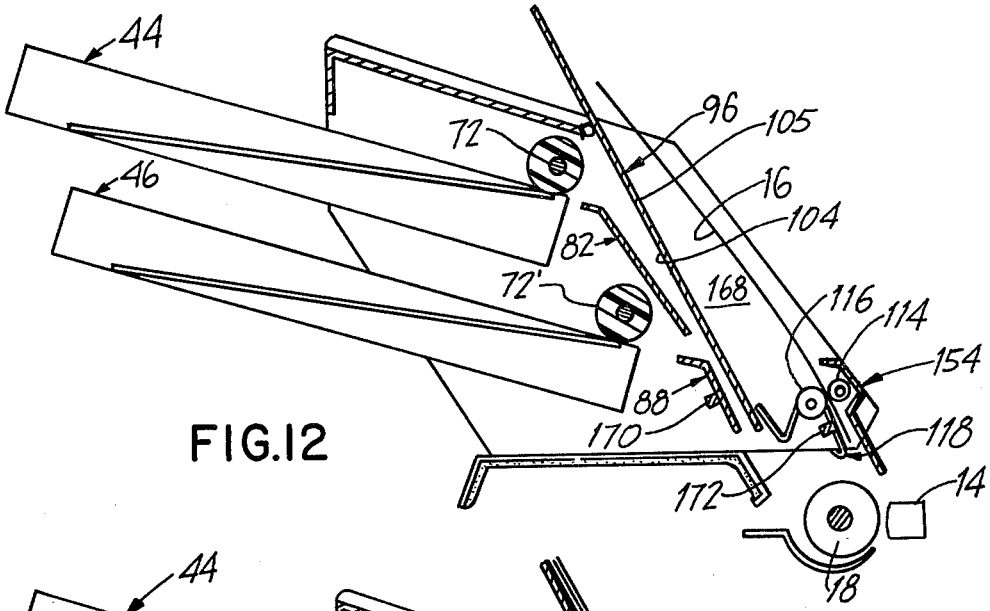
FIG. 12 is a schematic side elevational view, similar to that shown in FIG. 9, illustrating a sheet of paper being ejected from the printing device by the paper feeding apparatus of the present invention.
Figure 13:
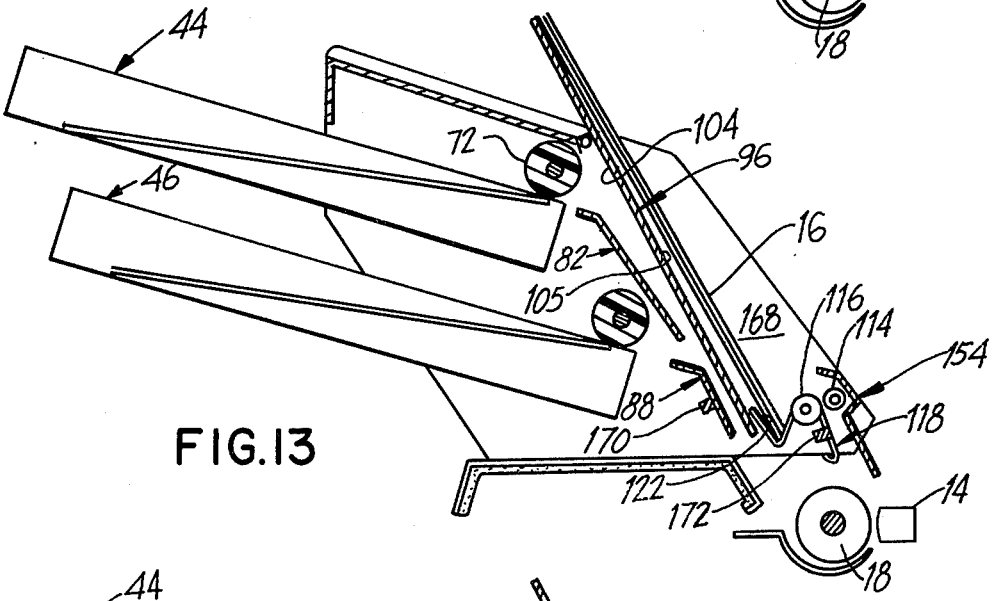
FIG. 13 is a schematic side elevational view, similar to that shown in FIG. 9, illustrating sheets of paper stacked on the stacker/deflector plate of the paper feeding apparatus.
Figure 14:
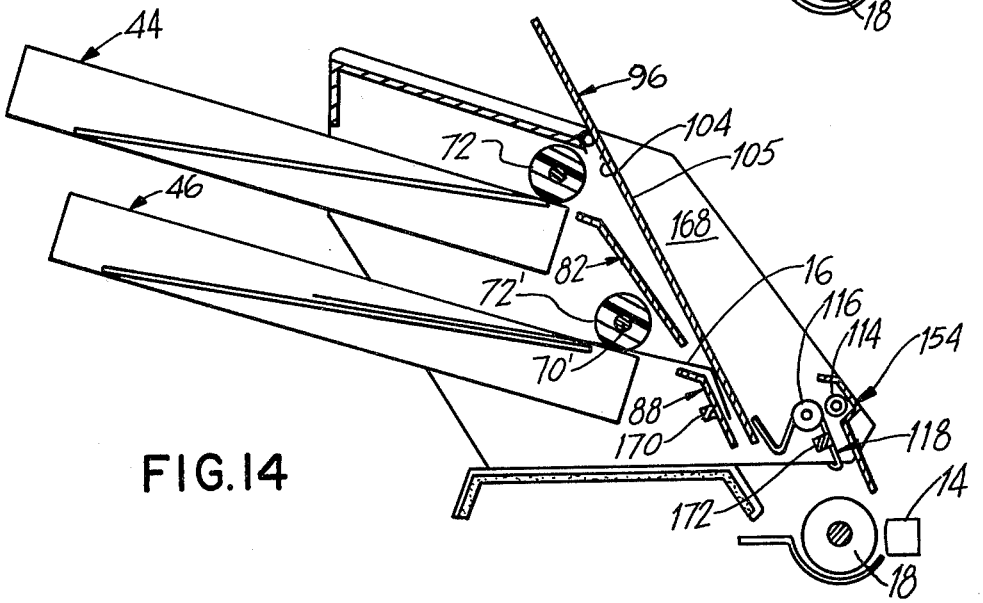
FIG. 14 is a schematic side elevational view, similar to that shown in FIG. 9, illustrating a sheet of paper being fed from the lower paper tray.
Figure 15:
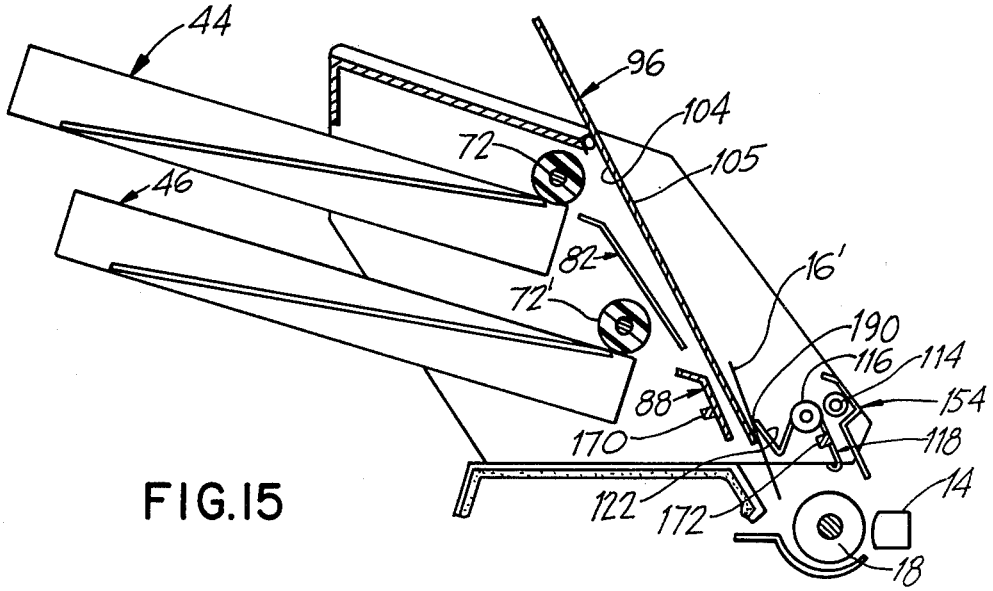
FIG. 15 is a schematic side elevational view, similar to that shown in FIG. 9, illustrating an envelope being manually fed through a manual input slot of the paper feeding apparatus.

The platen 18 is continued to be driven to advance the leading edge of the paper 16 in the exit path 160 and past the paper outlet sensor 172 (see FIG. 10). In this regard, it is to be noted that the platen 18 is driven by using conventional commands of the printing device 12 for advancing the platen 18. Thus, in terms of an impact printing device 12 which incrementally advances paper, a sheet of paper 16 is advanced incrementally during this feeding operation by simply directing the printing device 12 to advance the platen 18 a specified number of increments. In the preferred embodiment, the platen 18 is advanced to move the paper 16 in ½ inch steps. For example, if each platen increment corresponds to 1/48 inch of movement of the paper 16, the platen 18 would be advanced 24 increments at a time in this operation.

After a predetermined number of increments of platen rotation (corresponding to the distance from the inlet 106 to the platen 18 to the outlet sensor 172), the paper 16 should be moved past the paper outlet sensor 172. If the outlet sensor 172 does not close within a predetermined number of increments of the platen rotation (corresponding to the initial state of the $S_{out}$ counter), an alarm and fault signal 188*a* are generated to alert the operator to a possible paper jam. This is accomplished by testing of the outlet sensor $S_{out}$, as indicated by the diamond 316, after the tray drive rollers 72 have been turned off. If the outlet sensor $S_{out}$ has not closed, a test is made as to whether the $S_{out}$ counter is zero, as indicated by the arrow 318 and the diamond 320. If the $S_{out}$ counter is zero, an alarm is actuated as indicated by the arrow 322 and the rectangle 324, and the paper feeding apparatus 10 returns to the Routine A (200). In the preferred embodiment, the actuation of this alarm comprises sounding an alarm and lighting the light 188*a*. If the $S_{out}$ counter is not zero, the outlet sensor $S_{out}$ is again tested to determine whether it has closed, as indicated by the arrow 326 and diamond 316. This loop is continued until either the $S_{out}$ counter is zero, in which event an alarm is actuated, or until $S_{out}$ has closed.

Once the paper outlet sensor $S_{out}$ (172) detects or senses the leading edge of the paper 16, the platen 18 is controlled to move in the reverse direction to move the leading edge of the sheet 16 slowly back until the paper outlet sensor 172 opens. At this moment, the movement of the platen 18 is stopped (see FIG. 11), with the leading edge of the paper 16 being aligned with the paper outlet sensor $S_{out}$ (172). This provides a fixed or known reference point for the purposes of aligning the sheet of paper 16 relative to the print head 14 for the beginning of printing. Specifically, by knowing the distance of the paper sensor 172 from the print head 14, and the distance the paper moves for each increment of the platen 18 advance or reverse, conventional printing commands can cause the paper 16 to be moved to the proper print position for the first line of print by advancing or reversing the platen 18 the required number of increments. For example, if the paper movement sensor 172 is located three inches from the print head 14 and a one inch margin is desired at the top edge of the paper, the platen 18 can be reversed to move the paper 16 two inches in the reverse direction. This operation of moving the platen 18 forward to move the leading edge of a sheet of paper 16 past the sensor 172, and then reversing the platen 18 movement is made in order to be able to move the platen 18 forward in relatively large increments (for example ½ inch steps) to achieve a relative fast speed of operation to align the paper 16.

More particularly, this operation for aligning the paper 16 for the start of printing is accomplished by reversing the platen 18 once the outlet sensor $S_{out}$ (172) closes, as indicated by the arrow 328 and rectangle 330. The platen 18 is then reversed slowly, for example in one step increments, and the outlet sensor $S_{out}$ is again sensed to determine whether it is still closed, as indicated by the diamond 332. If the outlet sensor $S_{out}$ remains closed, the platen 18 is again reversed one step, as indicated by the arrow 334 and rectangle 330. this operation is continued until the outlet sensor $S_{out}$ opens. At that moment, the platen 18 is stopped and the paper is then repositioned relative to the print head 14 by movement of the platen 18, as indicated by the arrow 336 and rectangle 338. Finally, the print head 14 is moved to the adjusted left margin of the paper 16, as indicated by the rectangle 338.

In this regard, since the paper 16 is not aligned with the left hand end or zero position of the printing device 12 which it is fed thereinto, but rather is inserted so that the center of the paper 16 is aligned with the center of the printing device 12 (i.e., since the paper 16 was fed with the longitudinal central portion being aligned with the longitudinal centerine of the paper feed path 100 and the center of the platen 18), margin adjust information is received or programmed in the paper feeding apparatus 10 to adjust the margin control information in the printing device 12 to provide the desired margins for printing. More specifically, before any printing operation is undertaken, the printing device 12 generally will generate a restore command which moves the print head 14 to the left hand end or zero position of the platen 18. The host program or processor for the prestored text contains appropriate margin information or commands for adjusting the print head 14 to provide a desired margin for the matter to be printed. This generally involves a command to move the print head 14 a specified distance from the left end or zero position of the platen 18 which would provide the desired margins on the printed sheet of paper if the paper 16 were aligned with the left hand end of the platen 18. Since the sheet of paper 16 is centrally fed by the paper feeding apparatus 10 in the present invention, by which it is known that the left hand edge of the sheet of paper is displaced a specified distance in from the left hand end of the platen 18, the margin adjust information simply adds a constant distance (corresponding to this known displacement of the left hand edge of the paper 16 from the left hand end of the platen 18) to the margin information in the host program or processor for the prestored text of material to be printed. For example, if the material to be printed is to have a one inch margin along the left hand edge of the paper 16, and if the left hand edge of the paper is displaced three inches from the left hand end or zero positions of the platen 18, the margin information in the printing device 12 (which would normally generate command to displace the print head 14 one inch in from the left or zero position of the platen 18) would be adjusted to displace the print head four inches (one inch margin and three inches because the paper 16 is centered on the platen 18) in from the left or zero position of the platen 18. This margin adjust information can be preprogrammed into microprocessor for the paper feeding apparatus 10 for each of the different paper trays 44, 46 if standard paper trays are used.

After the paper 16 has been moved to the proper print position for the beginning of printing and the print head 14 has been moved to the adjusted left margin of the paper, as indicated by the rectangle 338, the print mode is then entered, as indicated by the circular flag 340, and the printing device 12 proceeds in accordance with its program to print the material on the sheet of paper 16.

When the printing has been completed on the sheet of paper 16, the printing device 12 is stopped, such as for example by appropriate stop codes in the printing device 12. The paper feeding apparatus 10 will then automatically eject the paper 16 when the next sheet of paper is called for by the operator depressing one of the paper tray control switches **186*b* or 186*c* in which event the Reset, Eject and Feed Routine B will again be entered, as indicated by either of the circular flags 210, 218 in the flow chart of FIG. 16*a*. At this time, the sheet of paper 16 will be ejected from the printing device 12 (see FIG. 12) and stored in the output hopper or receptacle 168 (see FIG. 13**).

It will be appreciated that during the printing operations, the trailing edge of the paper 16, which in some instances may be in the paper feed path 100, is free to move back and forth along this path 100 without interference from the paper storing trays 44, 46 or drive rollers 72, 72' which are located transversely in the paper inlet feed paths 108, 110. This is a most important feature, since in impact type printing operations, the paper 16 must be capable of being moved back and forth by the platen 18 for the printing of subscripts, superscripts, charts or other special operations. Also, with the paper feeding apparatus 10, the paper is moved backwards to align the leading edge with the paper outlet sensor 172 and then further to set the desired top margin. More particularly, as can be seen from FIGS. 8–11, the paper 16, once it is released from the paper trays 44, 46, and drive rollers 72, 72' may be freely moved along the paper feed path 100 past the ends **108*b*, 110*b*, of the inlet feed paths 108, 110 for the upper and lower paper trays 44, 46**.

The paper feeding apparatus 10 is also capable of being used in conjunction with a stored text or material which includes appropriate codes for automatically feeding the paper 16 from the upper or lower trays 44, 46 and which are coded to indicate the end of a page of text or material to be printed. In this instance, the text or material is stored on the disk or other recording device may be modified to include automatic feed and eject operation codes which would thus serve to allow the printing of a plurality of pages of text automatically with the user only having to initially turn on the device. In this operation, the paper feeding apparatus 10 would automatically eject the paper 16 into the output receptacle 168 and feed a new sheet 16 into the printer 12 without any additional operation to be performed by the user. For example, such codes may include a code or command for indicating the proper paper tray 44, 46 to be used, such as an upper tray code or command, and a lower tray code or command, as well as an eject paper code command for ejecting paper when the print head 14 has completed printing on the sheet of paper 16. The eject code, depending on the type of word processing unit and printer 12 with which it is used, may include an eject code for the right hand margin of the printed matter when printing is always from the left to the right, or may include both left margin and right margin eject codes for use with a bi-directional printing technique where the print head 14 moves from the left to the right for one line of print, and, for the next or subsequent line, moves from the right to the left relative to the platen 18. In this type of automatic operation, when the print command is given, the paper feeder apparatus 10 will feed a paper from one of the two trays 44, 46, which command is programmed as the first text line of the page, with all subsequent paper feedings being from the selected tray or, if the opposite tray is selected, from the opposite tray, in which case all subsequent paper feedings will be from that tray. At the completion of each page of print, by properly programming appropriate eject codes into the text of the material, the system will automatically eject the paper 16 and feed a new sheet of paper 16 into proper printing position in the manner as described above.

In this regard, the codes appearing in the text of the material in essence serve to generate signals which are similar to the signals generated by either the upper or lower tray switches **186*b* or 186*c* being depressed (i.e., signals corresponding to the arrows 208 or 216**) and the eject codes or commands are equivalent to generating a signal similar to the reset switch being depressed (to be described hereinbelow), so that the paper feeding apparatus will enter the Reset, Eject and Feed Routines and operate in the same manner as described above.

Of course, it should be appreciated that this is only one way of automatically feeding, printing and ejecting paper, and that there are numerous other ways that such operations could be performed, as will be appreciated by those skilled in the art.

During operation of the paper feeding apparatus 10, the upper and lower tray switches **186*b* and 186*c* (if they have been depressed), are cleared (such as for example by providing spring biased switches normally biasing the switches 186*b* and 186*c* to an undepressed state). Thus, upon return to the Feeder Control Routine A (200), the paper feeding apparatus 10 may again sense whether any switches have been depressed. This is a continuous routine, as indicated by the return arrow 372**, until and if further switches are depressed.

If an alarm has been actuated during the Reset, Eject and Feed Routine B, the alarm may be turned off by depressing the Reset Switch **186*a*. This is accomplished by returning to the Feeder Control Routine 200 and testing the condition of the Reset Switch 186*a*. More specifically, as noted above in the description of the Reset, Eject and Feed Routine B, after any alarm is actuated, the paper feeding apparatus 10 returns to A, the Feeder Control Routine 200. Since the upper and lower tray switches 186*b*, 186*c* have previously been cleared (and thus the tests of these switches, indicated by the diamonds 202, 214, are negative, as indicated by the arrows 212, 342), the paper feeding apparatus 10 will proceed to test whether the reset switch 186*a* is depressed, as indicated by the diamond 220. If the reset switch 186*a* is depressed, the paper feeding apparatus 10 will proceed to test whether an error condition exists, as indicated by the arrow 344 and diamond 346. This error condition would correspond to one of the alarms being actuated, and could typically be indicated by setting of an alarm flag whenever an alarm is actuated and testing whether an alarm flag has been set. If an error condition does exist, the alarm is turned off (in particular the sound alarm), as indicated by the arrow 348 and the rectangle 350. Then, the reset switch 186*a* is again tested, as indicated by the diamond 352. If the reset switch 186*a* has been depressed again, a restore command is generated for the printing device 12**, as indicated by the arrow 356 and rectangle 358. It should be noted here that the reset switch 186*a*, when an alarm is actuated, is simply pressed once and released to turn off the alarm. It is thereafter pushed a second time to generate the reset command and clear any alarm flags. The paper feeding apparatus 10 then returns to the Feeder Control Routine A, as indicated by the circular flag 360. If the reset switch 186*a* has not been depressed, the paper feeder simply returns to check the reset switch 186*a* until it is depressed again, as indicated by the arrow 354 and the diamond 352. Once an error condition has been detected, the reset switch 186*a* must be depressed a second time before any printing or further feeding operations are continued.

The reset switch 186*a* may also be utilized to eject paper 16 from the printing device 12. More specifically, if the test of the reset switch 186*a*, as indicated by the diamond 220, is positive, and there is no error condition, the paper feeding apparatus 10 will enter the Reset, Eject and Feed Routine B for the reset mode, as indicated by the arrow 362 and the circular flag 364. Also, similar to the situation where the upper or lower tray switches 186*b*, 186*c* are depressed, a reset flag will be set before the Reset, Eject and Feed Routine B is entered so that the Reset, Eject and Feed Routine B may be exited at the appropriate time.

When the Reset, Eject and Feed Routine B 224 is entered for the reset mode, the same set of operations as were initially performed upon depressing of the upper or lower tray switches 186*b* or 186*c* are performed to clear the printing device 12 of any paper 16 which may be therein. The only difference is that once the inlet and outlet sensors $S_{in}$ and $S_{out}$ are both cleared or opened, as indicated by the arrow 274 or 264 (assuming no jam which would cause actuation of an alarm indicated by the rectangle 282), the paper feeding apparatus 10 exits from the reset mode and returns to the paper feeding routine A, as indicated by the line 268, the arrow 270 and the circular flag 365, prior to determining whether paper is in any tray 44, 46.

A further feature of the paper feeding apparatus 10 of the present invention is the provision that individual sheets of paper 16 may be inserted into the printer platen 18 without removal of the paper feeding apparatus 10 from the printer 12. This is accomplished by moving or depressing the mode switch 186*d* to manual operation which will leave the paper feeding apparatus 10 electrically connected to the printing device 12 but transparent to the system (i.e., the paper feeding apparatus 10 appears not to be connected to the system). The paper feeding apparatus 10 may then be tilted upwardly to its raised position (see FIG. 3) by depressing of the locking switch 42 to thereby provide access to the printer platen 18 without inteference from the paper feeding apparatus 10. The paper feeding apparatus 10 may either be supported on the printer 12 in the raised position or can be removed from the printer 12. In this manual mode of operation, the printer device 12 would operate as if the paper feeding apparatus 10 did not exist so that the user may simply insert the sheet of paper 16 into the platen 18 and manually align same.

In terms of the flow diagram of FIG. 16*a*, the mode switch 186*d* is tested during the Feeder Control Routine (200) as indicated by the diamond 222. If the mode switch 186*d* is depressed, the print mode of the printing device 12 is entered as indicated by the arrow 368 and the circular flag 370. If the mode switch 186*d* is not depressed, as indicated by the arrow 372, the Feeder Control Routine 200 proceeds with testing of the other switches 186*b*, 186*c*, 186*a* on the control panel 184, as indicated by the diamonds 202, 214, 220.

A still further feature of the paper feeder apparatus 10 of the present invention is the provision for envelope or single sheet feeding without having to remove the paper feeding apparatus 10 from the printer 12. In this mode of operation, envelopes or other non-standard sheets of paper 16′ can be fed manually through the paper feeding apparatus 10 to the printer platen 18. In this instance, a special input slot 190 in the output hopper or receptacle 168 of the paper feeding apparatus 10 is provided. More particularly, as best seen in FIGS. 8–15, the V-shaped surface 122 of the exit guide plate member 118 is spaced from the deflector plate 96, thus defining the input slot 190 which communicates with the paper feed path 100 to the platen 18 at a position in the paper inlet feed path 100 below the lower paper tray 46. The envelope or other non-standard size of paper 16′ can thus be fed directly into the paper receiving inlet 106 for the paper platen 18.

To utilize this feature, all the paper 16 in the output hopper 168 must be removed and the reset switch 186*a* pushed to eject any paper 16 which may be in the printer 12 and paper feed and exit paths 100, 160, and to move the print wheel 14 to the left most printing position. Then, the upper and lower paper tray switches 186*b*, 186*c* are depressed simultaneously which will position the print wheel or print head 14 in the center of the printer 12 and place the paper feeding apparatus 10 in the envelope/single sheet mode. The envelope or sheet of paper 16′ is then placed in the input slot 190 therefor and the paper 16′ is positioned or aligned with the printer device 12 by manual operation of the platen knob. The paper 16′ is now in position for printing the page directly with the use of the word processing printing commands.

In terms of the Feeder Control Routine shown in FIG. 16*a*, the paper feeder apparatus 10 tests whether both the upper and lower tray switches 186*b*, 186*c* have been depressed together. This is accomplished with the test of whether the upper tray switch 186*b* is depressed as indicated by the diamond 202, previously described.

As noted above, if the upper paper switch 186*b* is depressed, the state of the lower tray switch 186*c* is then tested, as indicated by the arrow 204 and the diamond 206. (As noted above, if the test is negative, as indicated by the arrow 208, the paper feeding apparatus 10 enters the Reset, Eject and Feed Routine B for the upper paper tray 44.) If the lower tray switch 186*c* is also depressed, the print head 14 is centered, as indicated by the arrow 374 and the rectangle 376, and the print mode is entered, as indicated by the circular flag 378, and printing may be commenced. In the preferred embodiment, when the system has been placed in the envelope mode, depression of either of the upper or lower switches 186*b*, 186*c* will feed a sheet of paper 16 from the selected paper tray 44, 46 with the system still remaining in the envelope mode.

The electrical connections of the paper feeding apparatus 10 are made with the control circuitry or unit for the printing device 12 which for example may include a microprocessor for processing the data stream from the word processing system, or the host processor of the data processing system controlling the printing device 12. In this regard, the electrical circuitry or connection 182 of the paper feeder apparatus 10 serves to interrupt receipt of information respecting the text when a new sheet of paper 16 is to be fed into the printing device 12 to allow the paper feeder apparatus 10 to feed and align a sheet of paper 16 in the printing device 12. In this instance, the paper feeding apparatus 10 generates a command to the host processor to delay feeding of the information respecting the text to be printed as well as other commands to permit the paper 16 to be fed into the device 12 and aligned. Once the feeding of the paper 16 into the device 12 has been accomplished and is aligned for the beginning of printing, the conventional control unit of the printing device 12 takes over and the page is printed on. It will be appreciated that one of the features of simplicity of the present invention, and which is particularly adapted for retrofitting of the paper feeding apparatus 10 on existing printing devices 12, is the fact that the paper feeding apparatus 10 uses the conventional codes or commands for positioning of the printing head 14 and advancing and reversing of the platen 18.

While the preferred embodiment of the present invention has been shown and described, it will be understood that such is merely illustrative and that changes may be made without departing from the scope of the invention as claimed.

What is claimed is:

1. Paper feeding apparatus for a printing device, said printing device including a transversely extending platen, a printing head transversely movable relative to said transversely extending platen, and a guide member for guiding a sheet of paper in a desired direction, said guide member being associated with said transversely movable print head and movable therewith, said transversely extending platen including paper drive means for providing relative longitudinal movement of a sheet of paper relative to said printing head to effect printing on said sheet of paper by transversely moving said printing head relative to said transversely extending platen and by longitudinally moving a sheet of paper relative to said printing head, said paper feeding apparatus comprising:

paper storing means for storing a plurality of individual sheets of paper;

paper feed means for feeding a sheet of paper in a paper feed direction from said paper storing means to said platen, said sheet of paper having a longitudinal central portion which extends in the paper feed direction and which is centrally located intermediate the edges of said sheet of paper which extends in the paper feed direction;

paper receiving means for receiving a sheet of paper from said platen, said paper receiving means defining a paper exit path having one end arranged adjacent said platen to receive a sheet of paper therefrom after said printing means has effected printing thereon; and centering means for transversely moving said print head and associated guide member to be in a position to overlie at least a part of the central portion of said sheet of paper when it is moved therepast upon initial feeding of a sheet of paper to said platen so that said guide member cooperates with said platen to guide said sheet of paper into said paper exit path as said sheet is moved past said guide member.

2. The paper feeding apparatus of claim 1 wherein said paper feeding means feeds a sheet of paper from said paper storing means to align the longitudinal central portion of said sheet of paper with the transverse center of said platen, and wherein said centering means transversely centers said print head and associated guide member relative to said transverse center of said platen upon initial feeding of a sheet of paper to said platen.

3. The paper feeding apparatus of claim 2 wherein said paper feed path has a longitudinal center line extending in the paper feed direction and aligned with the transverse center of said platen; wherein said paper storing means is positioned relative to said paper feed path so that the longitudinal center line of said paper feed path is aligned in the longitudinal central portion of said sheets of paper in said paper storing means, wherein said paper feeding means comprises transversely extending roller means rotatably supported for rotation about an axis extending perpendicular to the longitudinal central portion of said sheets of paper and adjacent to said paper storing means for engaging a sheet of paper in said paper storing means and for introducing a sheet of paper into said paper feed path whereby the sheet of paper is fed into said platen with the longitudinal center line of said paper feed path overlying the longitudinal central portion of said sheet of paper.

4. The paper feeding apparatus of claim 2 wherein said paper receiving means further includes receptacle means for receiving sheets of paper moved along said paper exit path.

5. The paper feeding apparatus of claim 4 wherein said receptacle means is at least partially defined by one side of a deflector plate arranged to receive sheets of paper moved along said paper exit path, the other side of said deflector plate at least partially defining said paper feed path.

6. Paper feeding apparatus for a printing device, said printing device including printing means for printing on a sheet of paper and paper drive means for providing relative movement between a sheet of paper and the printing means to effect printing on the sheet of paper, said paper feeding apparatus comprising:

paper storing means for storing a plurality of individual sheets of paper;

paper feed means for feeding a sheet of paper from said paper storing means along a paper feed path to said paper drive means;

sensor means for sensing when a sheet of paper is in position for being received by said paper drive means; and actuation means responsive to said sensing means for actuating said paper drive means to receive a sheet of paper and to move said sheet of paper relative to said printing means to accurately position said sheet of paper in a desired printing position for the start of printing thereon by said printing means.

7. The paper feeding apparatus of claim 6 wherein said sensing means comprises first detecting means for detecting the leading edge of a sheet of paper being fed along said paper feed path; and wherein said actuation means comprises drive start means for actuating said paper drive means at a first predetermined time after said first detecting means detects the leading edge of said sheet of paper to receive said sheet of paper and to drive said sheet of paper to move the leading edge of said sheet of paper past said printing means, and stop means for stopping said paper drive means when the leading edge of said sheet of paper has moved a first predetermined distance past said printing means.

8. The paper feeding apparatus of claim 7 in which said printing device includes guide means for directing the sheet of paper toward a paper exit path of movement after the paper has been moved past said printing means; wherein said actuation means further includes second detecting means for detecting the leading edge of said sheet of paper after passing said printing means, said second detecting means being arranged downstream of said printing means along said paper exit path of movement; and wherein said stop means is responsive to said second detecting means detecting the leading edge of said sheet of paper.

9. The paper feeding apparatus of claim 8 wherein said drive start means operates said paper drive means to move the leading edge of said sheet of paper in a paper feed direction past said second detecting means; and wherein said stop means comprises reverse feed means responsive to said second detecting means for reversing the direction of feed of said sheet of paper to move said sheet of paper in the opposite direction from said paper feed direction and for stopping the reverse feed means when said second detecting means detects the leading edge of said sheet of paper being in alignment therewith to thereby align said sheet of paper at a precise position in reference to a desired position for the beginning of printing thereon by said printing means.

10. The paper feeding apparatus of claim 9 wherein said reverse feed means comprises means for operating said paper drive means to feed said sheet of paper in said opposite direction.

11. The paper feeding apparatus of claim 8 further including first alarm means associated with said first detecting means for generating a first alarm signal a second predetermined time after said paper feeding means is actuated to feed a sheet of paper from said paper storing means if said first detecting means fails to detect the leading edge of a sheet of paper within said second predetermined time.

12. The paper feeding apparatus of claim 11 further including second alarm means associated with said second detecting means for generating a second alarm signal a third predetermined time after said first detecting means detects the leading edge of a sheet of paper if said second detecting means fails to detect the leading edge of a sheet of paper with said third predetermined time.

13. The paper feeding apparatus of claim 12 further including ejector drive means for engaging a sheet of paper after printing has been effected thereon and removing said engaged sheet of paper from said printing device.

14. The paper feeding apparatus of claim 13 wherein said second alarm means is operable to generate said second alarm signal a fourth predetermined time after said ejector drive means is actuated if said second detecting means fails to detect the trailing edge of a sheet of paper being moved therepast within said fourth predetermined time.

15. The paper feeding apparatus of claim 14 wherein said ejector drive means are positioned downstream in said paper feed direction of said second detecting means.

16. The paper feeding apparatus of claim 15 further including feed start means for actuating said paper feed means to begin operation to feed a sheet of paper to said paper drive means; and means responsive to actuation of said feed start means for actuating said ejection drive means if one of said first and second detecting means detects a sheet of paper in said paper feed path or said exit paper path of movement and for disabling operation of said paper feeding means until said first and second detecting means detect the absence of a sheet of paper in said paper feed path and in said paper exit path.

17. The paper feeding apparatus of claim 8 wherein said paper storing means comprises a first paper tray having a plurality of individual sheets of paper therein, said first paper tray being arranged adjacent to said paper feed path upstream of said first detecting means.

18. The paper feeding apparatus of claim 17 wherein said paper tray is positioned adjacent said paper feed path a distance from said second detecting means taken along said paper feed path and said exit path of movement which is greater than the longitudinal length of a sheet of paper in said paper tray.

19. The paper feeding apparatus of claim 17 further including paper tray sensing means for generating a signal in the absence of a sheet of paper being in said paper tray being in position for feeding to said paper drive means.

20. The paper feeding apparatus of claim 19 further including disabling means responsive to said signal generated by said paper tray sensing means for disabling said paper feeding means from operating.

21. The paper feeding apparatus of claim 17 further including a second paper tray having a plurality of individual sheets of paper therein, said second paper tray being spaced from said first paper tray and arranged adjacent to said paper feed path upstream of said first detecting means.

22. The paper feeding apparatus of claim 21 wherein said first and second paper trays are removably supported adjacent said paper feed path.

23. The paper feeding apparatus of claim 8 further including ejection means arranged along said exit path of movement for removing said sheet of paper from said printing device after printing has been effected on said sheet of paper.

24. The paper feeding apparatus of claim 23, further including receptacle means for receiving and storing said sheet of paper ejected by said ejection means.

25. The paper feeding apparatus of claim 24 wherein said receptacle means comprises a plate member arranged adjacent said exit path of movement and against one side of which sheets of paper are stacked after ejection by said ejection means.

26. The paper feeding apparatus of claim 25 wherein the side of said plate member opposite from said one side defines a portion of said paper feed path.

27. The paper feeding apparatus of claim 23 wherein said ejection means comprises a pair of spaced rotatable ejection drive rollers defining a portion of said paper exit path therebetween, and means for moving said pair of spaced ejection drive rollers toward one another to engage each sheet of paper therebetween and to rotate said ejection drive rollers to eject a sheet of paper from said printing device after printing has been effected on said sheet of paper, said ejection drive rollers being normally spaced from one another a distance to permit said sheet of paper to be guided therebetween and be freely moved therebetween during printing on said sheet of paper by said printing means.

28. The paper feeding apparatus of claim 6 wherein said paper feed path comprises a first paper feed path, and further including means defining a second paper feed path communicating with a portion of said first paper feed path for manually introducing a sheet of paper to said paper drive means.

29. The paper feeding apparatus of claim 28 further including a paper guide plate member having a first side defining said first paper feed path and a second side defining said second paper feed path, said paper guide plate member including an edge portion providing communication between said first and second paper feed paths, said edge portion being spaced from and adjacent said paper drive means.

30. The paper feeding apparatus of claim 6 wherein said paper feed means is operable to longitudinally feed a sheet of paper in a paper feed direction along said paper feed path, said sheet of paper having a pair of spaced edges extending longitudinally in said paper feed direction, and having a longitudinal central portion centered between said longitudinally extending spaced edges of said sheet of paper.

31. The paper feeding apparatus of claim 30 in which said paper drive means includes a transversely extending platen, and in which said printing means includes a movable print head transversely movable relative to said transversely extending platen, and a guide member for guiding a sheet of paper in a desired direction; and said paper feeding apparatus further including paper receiving means for receiving a sheet of paper as it leaves said guide means, said paper receiving means defining a paper exit path having one end arranged adjacent said transversely extending platen and downstream in said paper feed direction of said transversely movable print head and said guide member to receive a sheet of paper therefrom after said transversely movable print head has effected printing on said sheet of paper, and centering means for centering said guide member relative to the longitudinal central portion of said sheet of paper so that said guide member cooperates with said transversely extending platen to feed said sheet of paper to said paper receiving means.

32. The paper feeding apparatus of claim 31 wherein said paper receiving means includes receptacle means for receiving and storing sheets of paper received by said receiving means.

33. The paper feeding apparatus of claim 32 wherein said paper feed means is operable to longitudinally feed a sheet of paper to said transversely extending platen with the longitudinal central portion of said sheet of paper aligned with the transverse center of said transversely extending platen, and wherein said centering means comprises means for transversely centering said guide member relative to said transversely extending platen.

34. The paper feeding apparatus of claim 30 wherein said paper storing means comprises a paper tray positioned relative to said paper feed path so that said sheets of paper in said paper tray have their longitudinal central portion in alignment with the longitudinally extending center of said paper feed path, and wherein said paper feed means comprises a feed roller means rotatably supported to rotate about an axis extending perpendicular to the longitudinal central portion of said sheets of paper in said paper tray to feed a sheet of paper into said paper feed path so that the longitudinal central portion of said sheet of paper is in alignment with the longitudinal center of said paper feed path.

35. The paper feeding apparatus of claim 34 wherein said paper tray is oriented to extend in a direction transversely to the longitudinal direction of said paper feed path, and further including guide means for deflecting paper fed into said paper feed path to move along said paper feed path.

36. The paper feeding apparatus of claim 8 in which said paper drive means includes a paper inlet for receiving a sheet of paper to be moved past said printing means, and said paper feeding apparatus further including a supporting structure for supporting said paper feeding apparatus on said printing device to align said paper feed path to feed a sheet of paper to said paper inlet of said paper drive means and so that said paper exit path of movement is arranged to receive a sheet of paper from said paper drive means after printing has been effected on said sheet of paper as said sheet of paper is guided past said printing means.

37. The paper feeding apparatus of claim 6 wherein said paper feed means feeds a sheet of paper in a paper feed direction along said paper feed path, said paper feed means being adapted to release a sheet of paper when it is received by and initially moved by said paper drive means in said paper feed direction, said paper feed means further being so positioned that said paper feed means is out of the path of movement of a released sheet of paper when thereafter moved by said paper drive means so that said released sheet of paper may be moved freely by said paper drive means in said paper feed path without interference from said paper feed means.

38. The paper feeding apparatus of claim 37 wherein said paper storing means is positioned adjacent said paper feed path and oriented with respect thereto so that said individual sheets of paper therein are arranged to extend transversely of the longitudinal direction of said paper feed path.

39. The paper feeding apparatus of claim 6 wherein said paper feed means comprises guide means defining said paper feed path between said paper storing means and said paper drive means, and a pair of transversely spaced drive rollers for driving a sheet of paper from said paper storing means in a paper feed direction, said transversely spaced drive rollers being positioned adjacent said paper storing means and spaced from said guide means for directing a sheet of paper from said paper storing means into said paper feed path.

40. The paper feeding apparatus of claim 39 wherein said sheet of paper has a longitudinal center line which extends in the paper feed direction and which is centered intermediate the edges of said sheet of paper which extend in the paper feed direction, and wherein said spaced apart drive rollers are positioned to engage a sheet of paper at positions which are of equal distances from and on opposite sides of the longitudinal center line of a sheet of paper regardless of its width.

41. The paper feeding apparatus of claim 40 wherein said spaced apart drive rollers are rotatably mounted to rotate about a common axis of rotation which extends perpendicular to the paper feed direction of said sheet of paper from said paper storing means into said paper feed path.

42. The paper feeding apparatus of claim 41 wherein said paper feed path is aligned with the transverse center of said paper drive means so that the longitudinal center line of said sheet of paper will be aligned with the transverse center of said paper drive means when said sheet of paper is fed to said paper drive means.

43. The paper feeding apparatus of claim 40 wherein said paper feed means further includes a pair of idler rollers, said pair of idler rollers being spaced transversely from said pair of drive rollers with said pair of drive rollers being located therebetween for guiding a sheet of paper having a transverse width greater than the spacing between said first pair of drive rollers.

44. A method of feeding an individual sheet of paper to a printing device, which printing device includes printing means for printing on a sheet of paper and paper drive means for providing relative movement between a sheet of paper and the printing means to effect printing on the sheet of paper, said method comprising the steps of:

storing a plurality of individual sheets of paper in paper storing means;

feeding a sheet of paper from the paper storing means along a paper feed path to the paper drive means;

sensing when a sheet of paper is in position along said paper feed path for being received by the paper drive means; and actuating the paper drive means when a sheet of paper is sensed to receive a sheet of paper being fed along the paper feed path and to thereafter move the sheet of paper relative to said printing means to a printing position for the start of printing thereon by said printing means.

45. The method of feeding paper of claim 44 wherein said step of sensing comprises detecting at a first position in said paper feed path the leading edge of a sheet of paper being fed along said paper feed path, and wherein said step of actuating comprises actuating said paper drive means at a first predetermined time after the leading edge of said sheet of paper is detected at said first position in said paper feed path.

46. The method of feeding paper of claim 45 wherein said step of actuating comprises operating said paper drive means to receive the sheet of paper and to move the leading edge of the sheet of paper past said printing means, and stopping said paper drive means when the leading edge of said sheet of paper has moved a first predetermined distance past said printing means.

47. The method of feeding paper of claim 46 further including the steps of guiding the sheet of paper toward and along a paper exit path of movement after the sheet of paper has been moved past said printing means, and detecting at a second position in said paper exit path the leading edge of said sheet of paper after passing said printing means, said second position in said paper exit path being located at said first predetermined distance downstream of said printing means.

48. The method of feeding paper of claim 47 wherein said step of operating comprises operating said paper drive means to move the leading edge of said sheet of paper in a paper feed direction past said second position in said paper exit path and then reversing said paper drive means to move said sheet of paper in the opposite direction from said paper feed direction; and wherein said step of stopping comprises stopping operation of said paper drive means when the leading edge of said sheet of paper is detected at said second position in said paper exit path.

49. The method of feeding paper of claim 48 further including the step of generating a first alarm signal a second predetermined time after the start of said step of feeding a sheet of paper from said paper storing means if the leading edge of said sheet of paper is not detected at said first position in said paper feed path within said second predetermined time.

50. The method of feeding paper of claim 49 further including the step of generating a second alarm signal a third predetermined time after the leading edge of said sheet of paper is detected at said first position in said paper feed path if the leading edge of said sheet of paper is not detected at said second position in said paper exit path within said third predetermined time.

51. The method of feeding paper of claim 50 further including the step of ejecting a sheet of paper from said printing device after printing has been effected thereon.

52. The method of feeding paper of claim 51 further including the step of generating a third alarm signal a fourth predetermined time after the step of ejecting has commenced if the trailing edge of said sheet of paper is not detected at said second position in said paper exit path within said fourth predetermined time.

53. The method of feeding paper of claim 44 further including the steps of ejecting a sheet of paper from said printing device after printing has been effected on said sheet of paper, and of repeating said steps of feeding, sensing, actuating and ejecting for a plurality of succeeding sheets of paper after said printing device has effected printing on said sheet of paper to feed successive sheets of paper, one at a time to said printing device for subsequent printing thereon.

54. The method of feeding paper of claim 53 wherein the step of ejecting a sheet of paper from said printing device is performed prior to the step of feeding the next succeeding sheet of paper from said paper storing means.

55. The method of feeding paper of claim 54 further including the step of generating an empty signal when said paper storing means is empty and for preventing, in response to said empty signal, performance of said steps of feeding, sensing and actuating.

56. The method of feeding paper of claim 54 further including the step of storing ejected sheets of paper in a receptacle therefor.

57. The method of feeding paper of claim 44 in which said sheet of paper has a pair of spaced edges extending in a longitudinal direction, and a central portion centered between said pair of spaced edges; and wherein said step of feeding a paper from said paper storing means comprises longitudinally feeding of a sheet of paper in a paper feed direction along said paper feed path so that during movement of said sheet of paper, the center line of said paper feed path is aligned with said central portion of said sheet of paper.

58. The method of feeding paper of claim 57 in which said paper drive means comprises a transversely extending platen, and in which said printing means includes a movable print head transversely movable relative to said transversely extending platen and an associated guide member for guiding a sheet of paper in a desired direction, said guide member being transversely movable with said print head; and said method further including the step of moving said print head with said associated guide member to a transverse position relative to said platen to overlie said central portion of said sheet of paper as said sheet of paper is fed past said print head to guide said paper along an exit path of movement.

59. The method of feeding paper of claim 44 wherein said paper feed path comprises a first paper feed path having a first end and a second end; wherein said step of feeding comprises feeding of a sheet of paper from said paper storing means along a second paper feed path into said first paper feed path, said second paper feed path being positioned intermediate said first and second ends of said first paper feed path and transversely oriented with respect to said first paper feed path so that paper in said first paper feed path may move between said first and second ends of said first paper feed path without entering said second paper feed path.

60. Printing apparatus comprising:

printing means for printing on a sheet of paper;

paper drive means for providing relative movement between a sheet of paper and said printing means to effect printing on the sheet of paper;

paper storing means for storing a plurality of individual sheets of paper;

paper feed means for feeding a sheet of paper from said paper storing means along a paper feed path to said paper drive means;

sensor means for sensing when a sheet of paper is in position for being received by said paper drive means; and actuation means responsive to said sensing means for actuating said paper drive means to receive a sheet of paper and to move said sheet of paper relative to said printing means to accurately position said sheet of paper in a desired printing position for the start of printing thereon by said printing means.

61. The printing apparatus of claim 60 wherein said sensing means comprises first detecting means for detecting the leading edge of a sheet of paper being fed along said paper feed path; and wherein said actuation means comprises drive start means for actuating said paper drive means at a first predetermined time after said first detecting means detects the leading edge of said sheet of paper to receive said sheet of paper and to drive said sheet of paper to move the leading edge of said sheet of paper past said printing means, and stop means for stopping said paper drive means when the leading edge of said sheet of paper has moved a first predetermined distance past said printing means.

62. The printing apparatus of claim 61 further including guide means associated with said printing means for directing a sheet of paper toward a paper exit path of movement after the paper has been moved past said printing means; wherein said actuation means further includes second detecting means for detecting the leading edge of said sheet of paper after passing said printing means, said second detecting means being arranged downstream of said printing means along said paper exit path of movement; and wherein said stop means is responsive to said second detecting means detecting the leading edge of said sheet of paper.

63. The printing apparatus of claim 62 wherein said drive shaft means operates said paper drive means to move the leading edge of said sheet of paper in a paper feed direction past said second detecting means; and wherein said stop means comprises reverse feed means responsive to said second detecting means for reversing the direction of feed of said sheet of paper to move said sheet of paper in the opposite direction from said paper feed direction and for stopping the reverse feed means when said second detecting means detects the leading edge of said sheet of paper being in alignment therewith to thereby align said sheet of paper at a precise position in reference to a desired position for the beginning of printing thereon by said printing means.

64. The printing apparatus of claim 63 further including ejection means arranged along said exit path of movement for removing said sheet of paper from said printing device after printing has been effected on said sheet of paper.

65. The printing apparatus of claim 64 further including receptacle means for receiving and storing said sheet of paper ejected by said ejection means.

66. The printing apparatus of claim 60 wherein said paper drive means includes a transversely extending platen; wherein said printing means includes a movable print head transversely movable relative to said platen, and a guide member movable with said print head for guiding a sheet of paper in a desired direction after said sheet of paper is moved past said print head; wherein said paper feed means is operable to longitudinally feed a sheet of paper in a paper feed direction along said paper feed path, said sheet of paper having a pair of spaced edges extending longitudinally in said paper feed direction, and having a longitudinal central portion centered between said longitudinally extending spaced edges of said sheet of paper; and further including paper receiving means for receiving a sheet of paper as it leaves said guide means, said paper receiving means defining a paper exit path having one end arranged adjacent said transversely extending platen and downstream in said paper feed direction of said transversely movable print head and said guide member to receive a sheet of paper therefrom after said transversely movable print head has effected printing on said sheet of paper, and centering means for centering said guide member relative to the longitudinal central portion of said sheet of paper so that said guide member cooperates with said transversely extending platen to feed said sheet of paper to said paper receiving means.

67. The printing apparatus of claim 66 wherein said paper feed means is operable to longitudinally feed a sheet of paper to said transversely extending platen with the longitudinal central portion of said sheet of paper aligned with the transverse center of said transversely extending platen, and wherein said centering means comprises means for transversely centering said guide member relative to said transversely extending platen.

68. The printing apparatus of claim 60 wherein said paper feed means feeds a sheet of paper in a paper feed direction along said paper feed path, said paper feed means being adapted to release a sheet of paper when it is received by and initially moved by said paper drive means in said paper feed direction, said paper feed means further being so positioned that said paper feed means is out of the path of movement of a released sheet of paper when thereafter moved by said paper drive means so that said released sheet of paper may be moved freely by said paper drive means in said paper feed path without interference from said paper feed means.

69. The printing apparatus of claim 60 wherein said paper feed means comprises guide means defining said paper feed path between said paper storing means and said paper drive means, and a pair of transversely spaced drive rollers for driving a sheet of paper from said paper storing means in a paper feed direction, said transversely spaced drive rollers being positioned adjacent said paper storing means and spaced from said guide means for directing a sheet of paper from said paper storing means into said paper feed path.

70. The printing apparatus of claim 69 wherein said sheet of paper has a longitudinal center line which extends in the paper feed direction and which is centered intermediate the edges of said sheet of paper which extend in the paper feed direction, and wherein said spaced apart drive rollers are positioned to engage a sheet of paper at positions which are of equal distances from and on opposite sides of the longitudinal center line of a sheet of paper regardless of its width.

71. Printing apparatus comprising:

a transversely extending platen;

a printing head transversely movable relative to said transversely extending platen;

a guide member for guiding a sheet of paper in a desired direction, said guide member being associated with said printing head and movable therewith;

said transversely extending platen including paper drive means for providing relative longitudinal movement of a sheet of paper relative to said printing head to effect printing on said sheet of paper by transversely moving said printing head relative to said platen and by longitudinally moving a sheet of paper relative to said printing head;

paper storing means for storing a plurality of individual sheets of paper;

paper feed means for feeding a sheet of paper in a paper feed direction from said paper storing means to said platen, said sheet of paper having a longitudinal central portion which extends in the paper feed direction and which is centrally located intermediate the edges of said sheet of paper which extends in the paper feed direction;

paper receiving means for receiving a sheet of paper from said platen, said paper receiving means defining a paper exit path having one end arranged adjacent said platen to receive a sheet of paper therefrom after said printing means has effected printing thereon; and centering means for transversely moving said print head and associated guide member to be in a position to overlie at least a part of the central portion of said sheet of paper when it is moved therepast upon initial feeding of a sheet of paper to said platen so that said guide member cooperates with said platen to guide said sheet of paper into said paper exit path as said sheet is moved past said guide member.

* * * * *